US011726423B2

(12) United States Patent
Matsushita et al.

(10) Patent No.: US 11,726,423 B2
(45) Date of Patent: Aug. 15, 2023

(54) MEDIUM TRANSPORT DEVICE AND MEDIUM PROCESSING DEVICE USING THE SAME

(71) Applicant: FUJIFILM Business Innovation Corp., Tokyo (JP)

(72) Inventors: Kaoru Matsushita, Kanagawa (JP); Kiyotoshi Kaneyama, Kanagawa (JP); Koichi Sato, Kanagawa (JP); Kentaro Iwamoto, Kanagawa (JP); Hibiki Sasaki, Kanagawa (JP); Toshihiko Kamiyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 442 days.

(21) Appl. No.: 16/926,784

(22) Filed: Jul. 13, 2020

(65) Prior Publication Data

US 2021/0302891 A1 Sep. 30, 2021

(30) Foreign Application Priority Data

Mar. 27, 2020 (JP) ..... 2020-058625

(51) Int. Cl.
*B65H 5/02* (2006.01)
*G03G 15/00* (2006.01)

(52) U.S. Cl.
CPC ..... *G03G 15/6529* (2013.01); *B65H 5/021* (2013.01)

(58) Field of Classification Search
CPC ..... B65H 5/021; B65H 5/02; B65H 5/023; B65H 5/025; G03G 15/6529;
(Continued)

(56) References Cited

FOREIGN PATENT DOCUMENTS

| | | |
|---|---|---|
| JP | 2006267704 | 10/2006 |
| JP | 2006276294 | 10/2006 |
| JP | 2007011107 | 1/2007 |

*Primary Examiner* — Luis A Gonzalez
(74) *Attorney, Agent, or Firm* — JCIPRNET

(57) ABSTRACT

A medium transport device includes a transport belt that is disposed in such a manner as to face an image holding unit holding an image and that is capable of moving circularly so as to transport a medium, a first stretching roller that stretches a portion of the transport belt and that is disposed in such a manner as to face the image holding unit, the first stretching roller being configured to transport the medium by nipping the medium between the image holding unit and the transport belt and configured to transfer the image held by the image holding unit onto the medium, a second stretching roller that stretches a portion of the transport belt that is located downstream from the portion of the transport belt stretched by the first stretching roller in a transport direction of the medium, a contact adjusting unit that causes a second end of the first stretching roller in an axial direction of the first stretching roller to swing while a first end of the first stretching roller serves as a fulcrum and adjusts a contact state between the image holding unit and the transport belt in a longitudinal direction of a contact region between the image holding unit and the transport belt, and a position adjusting unit that keeps a distance between the center of the first stretching roller and the center of the second stretching roller constant and adjusts a position of the second stretching roller with respect to the first stretching roller by causing a second end of the second stretching roller to swing while a first end of the second stretching roller serves as a fulcrum.

20 Claims, 23 Drawing Sheets

(58) Field of Classification Search
CPC ..... G03G 15/161; G03G 15/1615; G03G 15/168; G03G 15/1661
See application file for complete search history.

MEDIUM TRANSPORT DEVICE AND MEDIUM PROCESSING DEVICE USING THE SAME

CROSS-REFERENCE TO RELATED APPLICATIONS

This application is based on and claims priority under 35 USC 119 from Japanese Patent Application No. 2020-058625 filed Mar. 27, 2020.

BACKGROUND

(i) Technical Field

The present disclosure relates to a medium transport device and a medium processing device that uses the medium transport device.

(ii) Related Art

As examples of this type of medium transport device, the devices described in Japanese Unexamined Patent Application Publication No. 2006-267704 (Best Mode for Carrying out the Invention, FIG. 3), Japanese Unexamined Patent Application Publication No. 2006-276294 (Best Mode for Carrying out the Invention, FIG. 1), and Japanese Unexamined Patent Application Publication No. 2007-11107 (Best Mode for Carrying out the Invention, FIG. 2) are known.

Japanese Unexamined Patent Application Publication No. 2006-267704 discloses an image forming apparatus in which a second transfer belt having elasticity is stretched between a pair of rollers and in which the inclination angle of one of the rollers with respect to the other is adjusted by an adjusting unit, the image forming apparatus being capable of adjusting the parallelism of an image by adjusting a transport direction of a sheet.

Japanese Unexamined Patent Application Publication No. 2006-276294 discloses an image forming apparatus including an image-parallelism adjusting mechanism that adjusts the parallelism of an image with respect to a widthwise direction, which is perpendicular to a transport direction of a recording material, by setting the press-contact degrees at the two ends of an elastic transfer roller in the axial direction of the elastic transfer roller to be different from each other so as to twist the elastic transfer roller.

Japanese Unexamined Patent Application Publication No. 2007-11107 discloses an image forming apparatus in which, when belt-walking of a second transfer-and-transport belt occurs, the outer-side end of a separation roller is swung about a rotary shaft of a driving roller so as to apply a torsional urging force to the second transfer-and-transport belt, so that the second transfer-and-transport belt is swung to the side opposite to its belt-walking.

SUMMARY

Aspects of non-limiting embodiments of the present disclosure relate to achieving both parallelism adjustment of an image that is transferred onto a medium and skew adjustment of the medium in an aspect in which the medium onto which the image is transferred is transported by a transport belt.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a medium transport device including a transport belt that is disposed in such a manner as to face an image holding unit holding an image and that is capable of moving circularly so as to transport a medium, a first stretching roller that stretches a portion of the transport belt and that is disposed in such a manner as to face the image holding unit, the first stretching roller being configured to transport the medium by nipping the medium between the image holding unit and the transport belt and configured to transfer the image held by the image holding unit onto the medium, a second stretching roller that stretches a portion of the transport belt that is located downstream from the portion of the transport belt stretched by the first stretching roller in a transport direction of the medium, a contact adjusting unit that causes a second end of the first stretching roller in an axial direction of the first stretching roller to swing while a first end of the first stretching roller serves as a fulcrum and adjusts a contact state between the image holding unit and the transport belt in a longitudinal direction of a contact region between the image holding unit and the transport belt, and a position adjusting unit that keeps a distance between a center of the first stretching roller and a center of the second stretching roller constant and adjusts a position of the second stretching roller with respect to the first stretching roller by causing a second end of the second stretching roller to swing while a first end of the second stretching roller serves as a fulcrum.

BRIEF DESCRIPTION OF THE DRAWINGS

An exemplary embodiment of the present disclosure will be described in detail based on the following figures, wherein.

DETAILED DESCRIPTION

Overview of Exemplary Embodiment

Figure 1A:
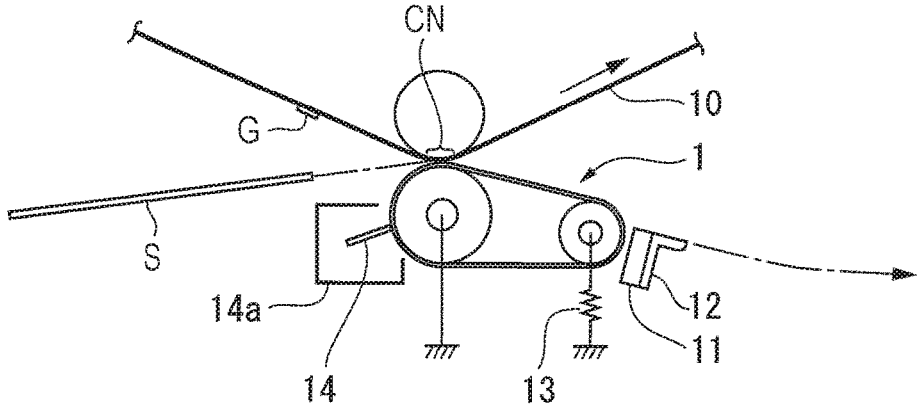
FIG. 1A is a diagram illustrating an overview of a medium processing device according to an exemplary embodiment of the present disclosure that includes a medium transport device to which the present disclosure is applied.

FIG. 1A is a diagram illustrating an overview of a medium processing device according to an exemplary embodiment of the present disclosure.

The medium processing device illustrated in FIG. 1A includes an image holding unit 10 that holds an image G and a medium transport device 1 that is disposed in such a manner as to face the image holding unit 10. The medium transport device 1 transfers the image G held by the image holding unit 10 onto a medium and transports the medium.

Figure 1B:
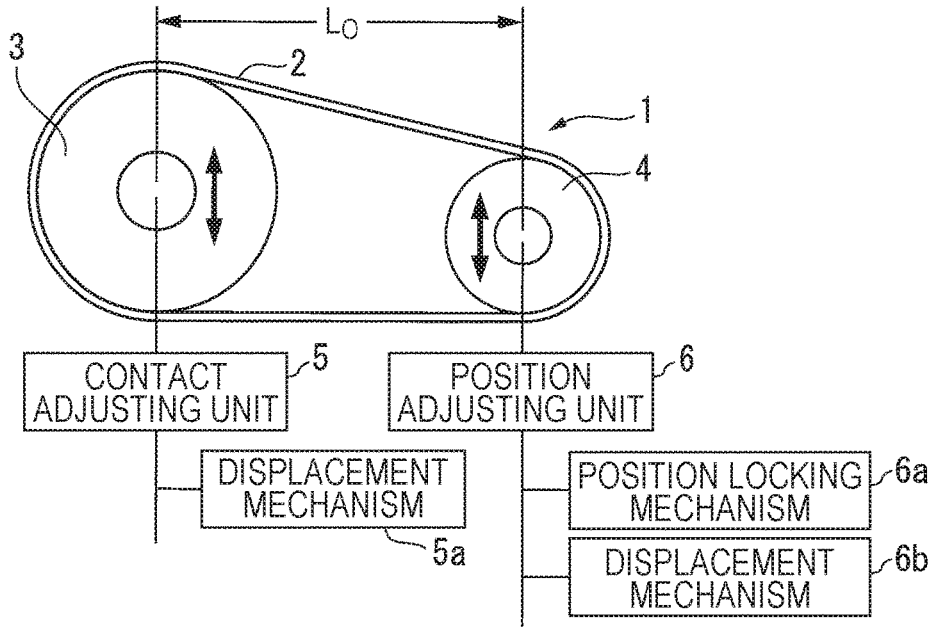
FIG. 1B is a diagram illustrating a principal portion of the medium transport device illustrated in FIG. 1A.
Figure 1C:
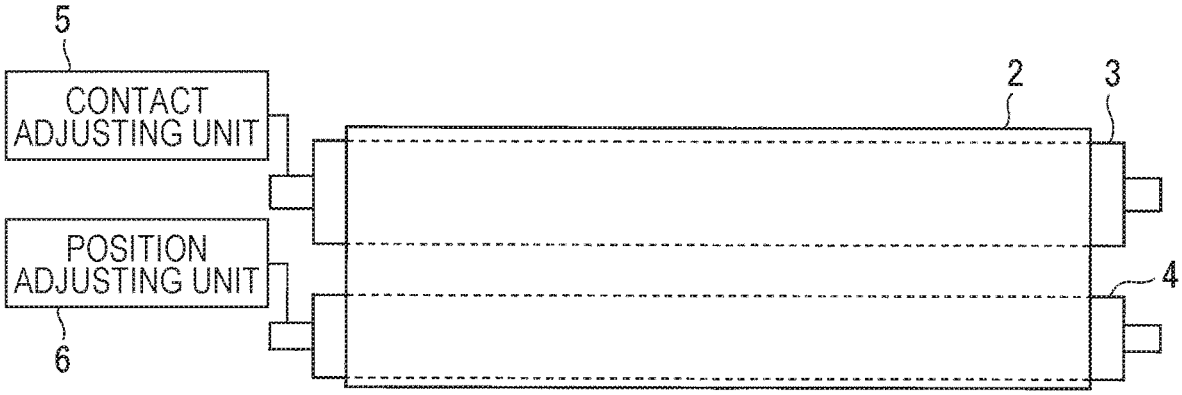
FIG. 1C is a diagram illustrating an installation example of a contact adjusting unit and an installation example of a position adjusting unit.

Here, as illustrated in FIGS. 1A to 1C, the medium transport device 1 includes an elastic transport belt 2 that is disposed in such a manner as to face the image holding unit 10 holding the image G and that transports a medium S, a first stretching roller 3 that is disposed in such a manner as to face the image holding unit 10 while stretching a portion of the transport belt 2, the first stretching roller 3 being configured to transport the medium S by nipping the medium S between the image holding unit 10 and the transport belt 2 and configured to transfer the image G held by the image holding unit 10 onto the medium S, a second stretching roller 4 that stretches a portion of the transport belt 2 that is located downstream from the portion of the transport belt 2 stretched by the first stretching roller 3 in a transport direction of the medium S, a contact adjusting unit 5 that causes a second end of the first stretching roller 3 in the axial direction of the first stretching roller 3 to swing while a first end of the first stretching roller 3 serves as a fulcrum so as to adjust a contact state between the image holding unit 10 and the transport belt 2 in the longitudinal direction of a contact region CN between the image holding unit 10 and the transport belt 2, and a position adjusting unit 6 that keeps a distance $L_O$ between the center of the first stretching roller 3 and the center of the second stretching roller 4 constant and causes a second end of the second stretching roller 4 in the axial direction of the second stretching roller 4 to swing while a first end of the second stretching roller 4 serves as a fulcrum so as to adjust the position of the second stretching roller 4 with respect to the first stretching roller 3.

In such technical measures, the medium transport device 1 widely includes devices each of which transfers the image G held by the image holding unit 10 onto a medium and transports the medium.

A method of transferring the image G is not limited to an electrostatic transfer and widely includes methods of transferring the image G by coming into contact with a medium. In addition, the image holding unit 10 is not limited to a photoconductor, a dielectric, or an intermediate transfer body and widely includes units each of which holds an image that has not yet been transferred to the medium S.

Although a belt member having elasticity may be used as the transport belt 2 in order to enable the transport belt 2 to deform along with swing movements of the stretching rollers 3 and 4, which are caused by the contact adjusting unit 5 or the position adjusting unit 6, the present disclosure also includes an aspect in which the transport belt 2 does not have elasticity, whereas the first stretching roller 3 and the second stretching roller 4 each have elasticity.

In addition, the present disclosure is not limited to an aspect in which the transport belt 2 is stretched only by the first stretching roller 3 and the second stretching roller 4 and includes an aspect in which an additional stretching roller is used.

Normally, the first stretching roller 3 is often used as a driving roller. However, the present disclosure is not limited to this case, and another stretching roller may be used as a driving roller.

The first stretching roller 3 is required to have a function of transferring the image G held by the image holding unit 10 (e.g., a function of serving as an electrode for forming a transfer electric field) in addition to a function of transporting the medium S by nipping the medium S between the first stretching roller 3 and the image holding unit 10.

A roller having a diameter smaller than that of the first stretching roller 3 may be used as the second stretching roller 4 from the standpoint of facilitating separation of the medium S from the transport belt 2.

The contact adjusting unit 5 may adjust the contact state between the image holding unit 10 and the transport belt 2 in the longitudinal direction of the contact region CN between the image holding unit 10 and the transport belt 2, specifically, the press-contact degree of the transport belt 2 and may adjust, for example, the contact pressure in the contact region CN substantially uniformly such that variations will not occur in the contact pressure in the contact region CN.

The position adjusting unit 6 is capable of adjusting skew of the transport belt 2 while taking advantage of adjustment made by the contact adjusting unit 5.

A representative aspect or an exemplary aspect of a medium transport device according to the present exemplary embodiment will now be described.

First, as a representative aspect of the contact adjusting unit 5, as illustrated in FIG. 1B, the contact adjusting unit 5 includes a displacement mechanism 5*a* that causes the second end of the first stretching roller 3 in the axial direction of the first stretching roller 3 to swing toward the image holding unit 10, which faces the contact adjusting unit 5.

In the present example, as an exemplary aspect of the contact adjusting unit 5, the displacement mechanism 5*a* causes a holding member by which the second end of the first stretching roller 3 in the axial direction of the first stretching roller 3 is rotatably held to linearly move forward and backward via an eccentric rotary member. In the present example, the eccentric rotary member (a cam member) is used in the displacement mechanism 5*a*.

As a representative aspect of the position adjusting unit 6, the position adjusting unit 6 includes position locking mechanisms 6*a* that are provided at the two ends of the first and second stretching rollers 3 and 4 and that allow rotational movements of both the first and second stretching rollers 3 4 in such a manner as to keep the distance $L_O$ between the centers of the first and second stretching rollers 3 and 4 constant and a displacement mechanism 6*b* that causes the second end of the second stretching roller 4 in the axial direction of the second stretching roller 4 to swing while the second end of the first stretching roller 3 in the axial direction of the first stretching roller 3 serves as a fulcrum.

Here, as an exemplary aspect of the position adjusting unit 6, the position locking mechanisms 6*a* include restricting rollers (not illustrated) that are arranged at the two ends of the first stretching roller 3 and at the two ends of the second stretching roller 4 such that each of the restricting rollers is coaxial with a corresponding one of the first and second stretching roller 3 and 4, space adjustment rollers (not illustrated) each of which is interposed between two of the restricting rollers in such a manner as to be in contact with the two restricting rollers, and holding frames (not illustrated) each of which holds two of the restricting rollers and one of the space adjustment rollers such that these rollers are rotatable and such that the axes of these rollers are aligned in a straight line.

As another exemplary aspect, the displacement mechanism 6*b* causes the second end of the second stretching roller 4 in the axial direction of the second stretching roller 4 to move forward and backward in a direction that is substantially perpendicular to a reference line connecting the axial center of the first stretching roller 3 and the axial center of the second stretching roller 4.

In the case where the medium transport device 1 includes peripheral components, its relative positional relationship with the peripheral components may be maintained.

For example, as an exemplary aspect in which the medium transport device 1 includes a static eliminating unit 11, the static eliminating unit 11 that removes static electricity from the medium S may be disposed further downstream than the transport belt 2 in the transport direction of the medium S and may be configured to move so as to follow the swing movement of the second stretching roller 4. In the present example, the static eliminating unit 11 is configured to move so as to follow the swing movement of the second stretching roller 4.

As another exemplary aspect in which the medium transport device 1 includes a guiding unit 12, the guiding unit 12 that guides the medium S may be disposed further downstream than the transport belt 2 in the transport direction of the medium S and may be configured to move so as to follow the swing movement of the second stretching roller 4. In the present example, the guiding unit 12 is configured to move so as to follow the swing movement of the second stretching roller 4.

As another exemplary aspect in which a high-resistive-element grounding system is employed, the second stretching roller 4 may be grounded via a high resistive element 13, and a portion connected to the high resistive element 13 may be configured to move so as to follow the swing movement of the second stretching roller 4. In the present example, the portion connected to the high resistive element 13 is configured to move so as to follow the swing movement of the second stretching roller 4.

Here, in the case where the static eliminating unit 11, the guiding unit 12, and the high-resistive-element grounding system are employed, as a configuration example, the transport belt 2, the first stretching roller 3, and the second stretching roller 4 are mounted on a swing frame (not illustrated) that is capable of swinging with respect to a stationary frame (not illustrated), and the swing frame has a portion that is connected to the static eliminating unit 11, the guiding unit 12, or the high resistive element 13.

As an exemplary aspect in which the medium transport device 1 includes a cleaning unit 14, the cleaning unit 14 that cleans the transport belt 2 may be disposed on the portion of the transport belt 2 that is stretched by the first stretching roller 3 and may be configured to move so as to follow the swing movement of the first stretching roller 3. In the present example, a cleaning housing 14*a* of the cleaning unit 14 is configured to, for example, move about a predetermined fulcrum and follow the swing movement of the first stretching roller 3.

In addition, as another exemplary aspect of the medium transport device 1, the medium transport device 1 includes a contact/separation unit (not illustrated in FIGS. 1A to 1C) that causes the medium transport device 1 to come into and out of contact with the image holding unit 10. For example, when a medium has become jammed (when medium jam has occurred) between the image holding unit 10 and the medium transport device 1, the contact/separation unit is capable of separating the image holding unit 10 and the medium transport device 1 from each other so as to address the medium jam.

As another exemplary aspect of the medium transport device 1, the image holding unit 10 includes a second contact adjusting unit (not illustrated in FIGS. 1A to 1C) that adjusts the contact state in the contact region CN more roughly than the contact adjusting unit 5 of the medium transport device 1 does.

In the present aspect, in particular, the medium transport device 1 may be disposed below the image holding unit 10 in such a manner as to be capable of being drawn out from a medium processing device housing (not illustrated).

In addition, in the present aspect, an opposing component member that is included in the medium transport device 1 and that faces an opposing component member included in the image holding unit 10 with the contact region CN interposed between the opposing component members may have a hardness smaller than that of the opposing component member included in the image holding unit 10. Here, the opposing component member included in the medium transport device 1 refers to a combination of the transport belt 2 and the first stretching roller 3, and the opposing component member included in the image holding unit 10 refers to, for example, a combination of a belt-shaped intermediate transfer body and a counter roller when the image holding unit 10 that employs an intermediate transfer system. Although the hardness of each of the opposing component members depends on the hardness of each of the members included in the opposing component member, in the case where the members have different hardnesses, the hardness of the opposing component member is the hardness when a combination of these members is seen as a whole, and in this case, it is assumed that the hardness of the member having a smaller hardness contributes to the hardness of the opposing component member.

In the present example, since the hardness of the opposing component member of the medium transport device 1 is smaller than the hardness of the opposing component member of the image holding unit 10, the contact state between the medium transport device 1 and the image holding unit 10 in the contact region CN is more likely to vary on the side of the medium transport device 1. Thus, as the contact adjusting unit 5 on the side of the medium transport device 1, the contact state in the contact region CN may be slightly adjusted by a small adjustment amount.

In addition, the hardness of the opposing component member of the medium transport device 1, which is smaller, varies due to aging of the opposing component member or manufacturing tolerances, and thus, slight adjustment that is performed by the contact adjusting unit 5 is also effective for such variations.

The present disclosure will be described in further detail below on the basis of the exemplary embodiment illustrated in the accompanying drawings.

Exemplary Embodiment

Figure 2:
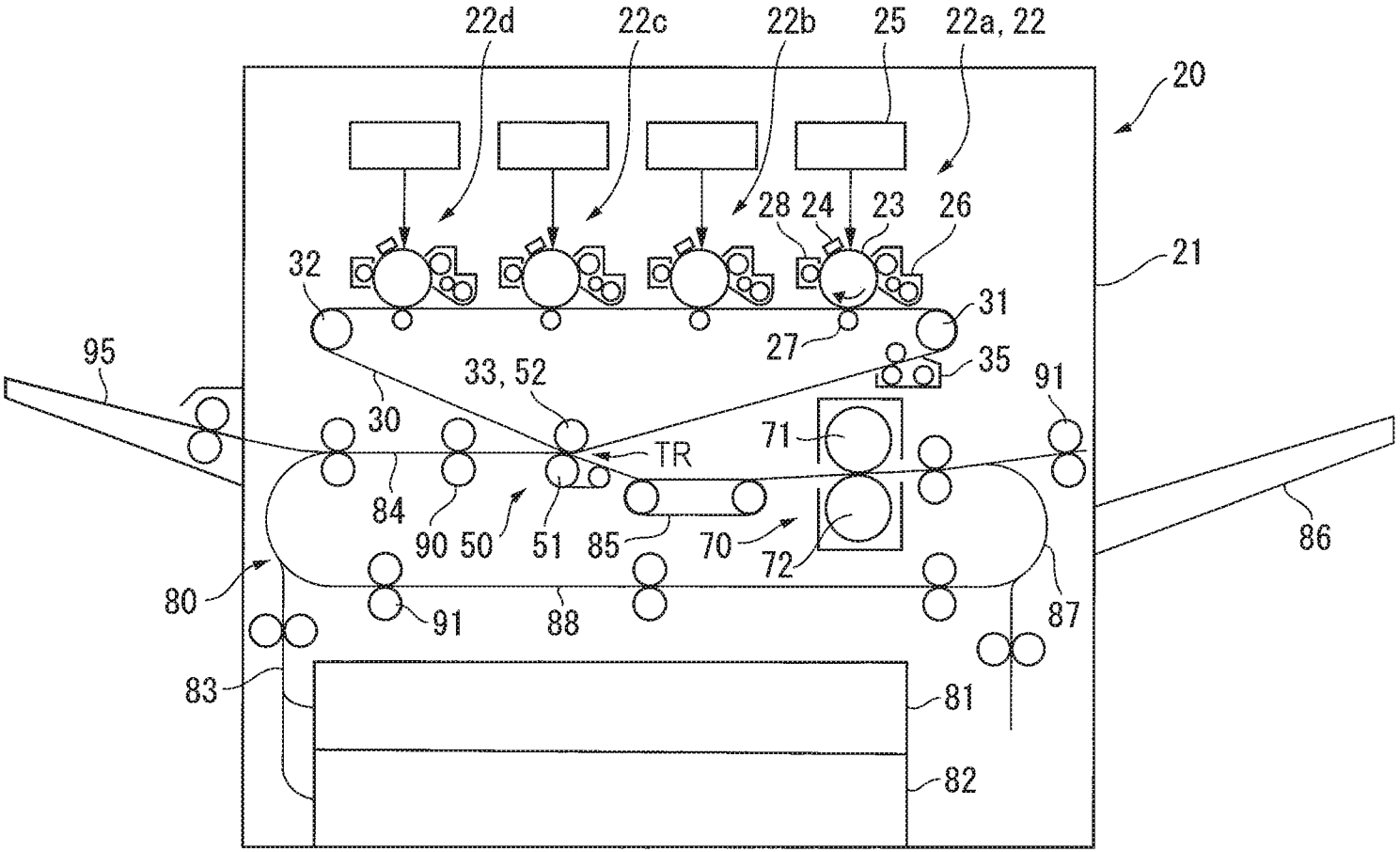
FIG. 2 is a diagram illustrating an overall configuration of an image forming apparatus that is an example of the medium processing device according to the exemplary embodiment.

FIG. 2 illustrates an overall configuration of an image forming apparatus that is an example of the medium processing device according to the exemplary embodiment.

—Overall Configuration of Image Forming Apparatus—

An image forming apparatus 20 that is illustrated in FIG. 2 includes an apparatus housing 21, image forming units 22 (specifically, 22*a* to 22*d*) that form images each having one of a plurality of color components (yellow, magenta, cyan, and black in the present exemplary embodiment), a belt-shaped intermediate transfer body 30 that holds the different color component images, which are formed by the image forming units 22 and which are sequentially transferred (in a first transfer process) onto the intermediate transfer body 30, a second transfer device (a collective transfer device) 50 that transfers (collectively transfers) the different color component images, which have been transferred to the intermediate transfer body 30, onto a medium (e.g., a sheet) in a second transfer process, a fixing device 70 that fixes the images, which have been transferred to the medium in the second transfer process, onto the medium, and a medium transport system 80 that transports the medium to a second transfer region TR.

—Image Forming Unit—

In the present exemplary embodiment, each of the image forming units 22 (22*a* to 22*d*) includes a drum-shaped photoconductor 23, and the following devices are disposed around the photoconductor 23: a charging device 24 such as a corotron or a transfer roller that charges the photoconductor 23, a latent-image writing device 25 such as an LED writing head that writes an electrostatic latent image onto the charged photoconductor 23, a developing device 26 that develops the electrostatic latent image written on the photoconductor 23 with a corresponding one of the color component toners, a first transfer device 27 such as a transfer roller that transfers the toner image formed on the photoconductor 23 onto the intermediate transfer body 30, and a photoconductor cleaning device 28 that removes residual toner on the photoconductor 23.

—Intermediate Transfer Body—

The intermediate transfer body 30 is stretched by a plurality of (three in the present exemplary embodiment) stretching rollers 31 to 33. For example, the stretching roller 31 is used as a driving roller that is driven by a driving source (not illustrated), and the intermediate transfer body 30 is caused to move circularly by the driving roller. In addition, an intermediate-transfer-body cleaning device 35 is disposed between the stretching rollers 31 and 33 and removes residual toner on the intermediate transfer body 30 after the second transfer process.

In the present example, a member that serves as the intermediate transfer body 30 may be suitably selected, and for example, a belt member made of a synthetic resin, such as a polyimide or a polyamideimide, is employed. An elastic material such as urethane rubber is used for forming the stretching rollers 31 to 33.

Figure 4:
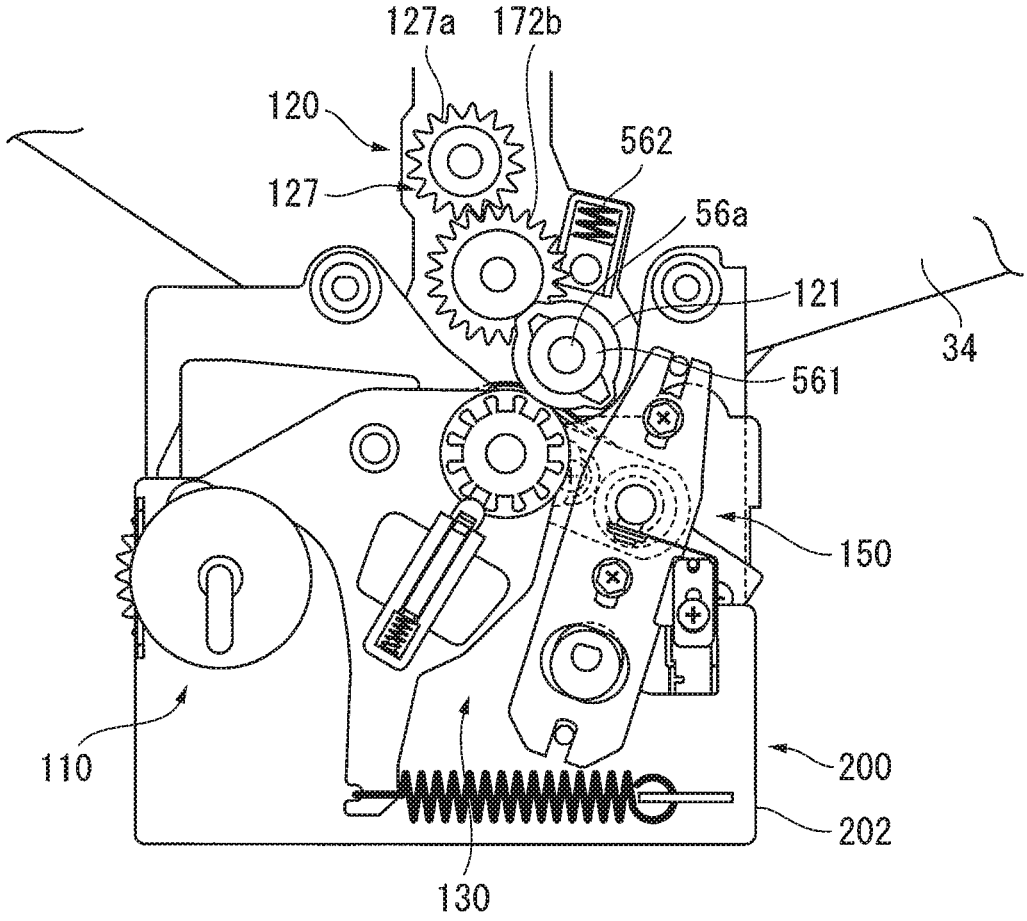
FIG. 4 is a diagram illustrating the configuration in the vicinity of the second transfer device according to the exemplary embodiment.

Note that, as illustrated in FIG. 4, the intermediate transfer body 30 and the stretching rollers 31 to 33 are held by an intermediate transfer frame 34 and are integrated with one another so as to form an intermediate transfer module.

—Second Transfer Device (Collective Transfer Device)—

Figure 3:
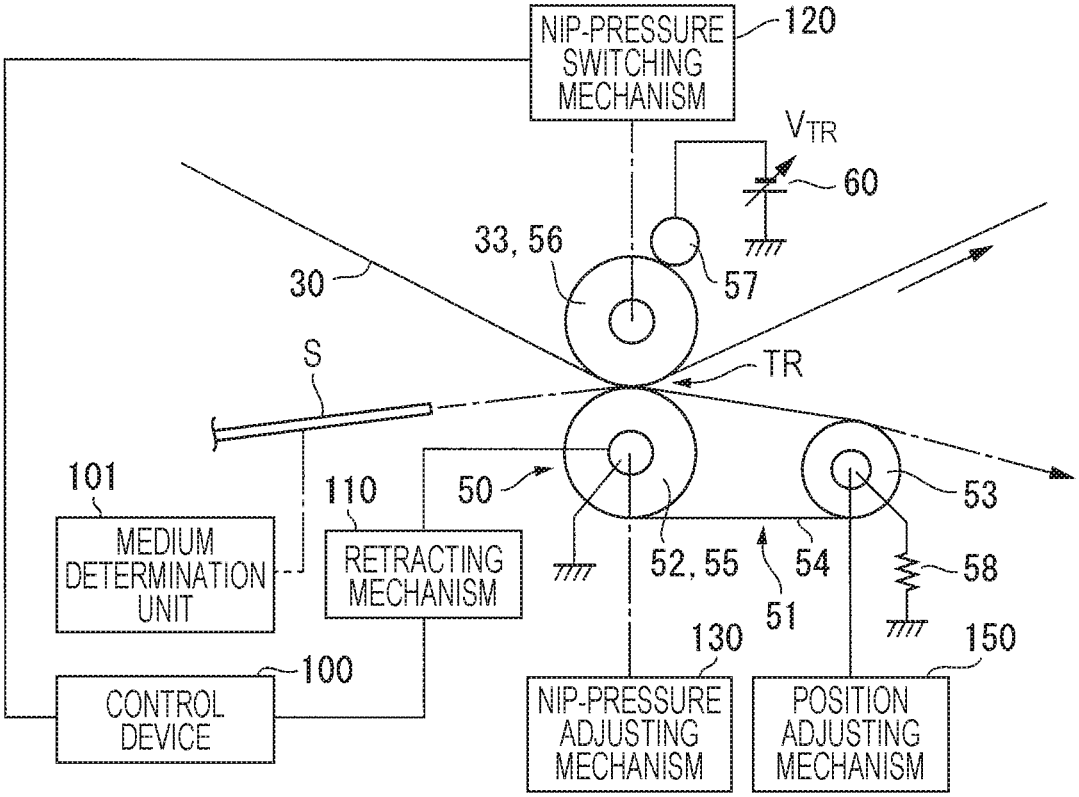
FIG. 3 is a diagram schematically illustrating components that are arranged in the vicinity of a second transfer device according to the exemplary embodiment.

The second transfer device (collective transfer device) 50 also functions as a medium transport device, and as illustrated in FIG. 2 and FIG. 3, a transfer belt unit 51 in which a transfer-and-transport belt 54 is stretched by a plurality of (e.g., two) stretching rollers 52 and 53 is disposed in such a manner as to be in contact with a surface of the intermediate transfer body 30. In particular, in the present example, the transfer belt unit 51 is retractably supported by retracting mechanisms 110 (see FIG. 6 and FIG. 7), which will be described later, and accordingly, the transfer belt unit 51 is capable of coming into and out of contact with the intermediate transfer body 30.

Here, the transfer-and-transport belt 54 is a semiconducting elastic belt that is made of an elastic material, such as urethane rubber, and that has a volume resistance of 8.5 to 10.0 log Ω. The first stretching roller 52 is configured to serve as a transfer roller 55, and the transfer roller 55 is disposed in such a manner as to be press-contacted against the intermediate transfer body 30 with the transfer-and-transport belt 54 interposed therebetween in the second transfer region (a collective transfer region) TR. In addition, the stretching roller 33 of the intermediate transfer body 30 is used as a counter roller 56, which serves as a counter electrode with respect to the transfer roller 55, and a transport path for the medium S is formed in such a manner as to extend from the position of the first stretching roller 52 to the position of the second stretching roller 53. The second stretching roller 53 functions as a separation roller.

In the present example, the first stretching roller 52 (used as the transfer roller 55) is formed by covering the periphery of a metal shaft with an elastic layer that is made of a foamed material, such as foamed urethane rubber, containing carbon black or the like. In contrast, the second stretching roller 53 is formed of, for example, a metal roller. In the present example, the first stretching roller 52 of the transfer belt unit 51 is directly grounded, and the second stretching roller 53 is grounded via a high resistive element 58 having a resistance of, for example, about 500 MΩ so as to prevent the transfer-and-transport belt 54 from being charged.

In particular, in the present example, as the opposing component members that face each other with the second transfer region TR interposed therebetween, a member that has a hardness lower than that of the intermediate transfer body 30 is selected for the transfer-and-transport belt 54, and a member that has a hardness lower than that of the counter roller 56 (stretching roller 33) is selected for the first stretching roller 52 (transfer roller 55). Thus, in the present example, the opposing component member of the transfer belt unit 51 (transfer-and-transport belt 54+first stretching roller 52 in the present example) that faces the intermediate transfer module with the second transfer region TR interposed therebetween has a hardness lower than that of the opposing component member of the intermediate transfer module (intermediate transfer body 30+counter roller 56 in the present example).

Note that, in the present example, although rollers whose diameter dimensions are approximately equal to each other are used as the first stretching roller 52 and the second stretching roller 53, considering the releasability of the medium S at a downstream end of the transfer-and-transport belt 54, the second stretching roller 53 may be caused to function as a separation roller having a diameter smaller than that of the first stretching roller 52.

In addition, a transfer voltage $V_{TR}$ is applied to the counter roller 56 (also used as the stretching roller 33 in the present example) from a transfer power supply 60 via a power supplying roller 57 having electrical conductivity such that a predetermined transfer electric field is formed between the transfer roller 55 and the counter roller 56.

—Fixing Device—

As illustrated in FIG. 2, the fixing device 70 includes a heating-and-fixing roller 71 that is disposed in such a manner as to be brought into contact with an image holding surface of the medium S and that is capable of rotating as a result of being driven and a pressing-and-fixing roller 72 that is disposed at a position facing the heating-and-fixing roller 71 so as to be pressed into contact with the heating-and-fixing roller 71 and that rotates along with rotation of the heating-and-fixing roller 71. The medium S holding an image is caused to pass through a transfer region that is formed between the fixing rollers 71 and 72, and the image is heated, pressurized, and fixed onto the medium S.

—Medium Transport System—

As illustrated in FIG. 2 and FIG. 3, the medium transport system 80 includes a plurality of (two in the present example) medium-feeding containers 81 and 82 stacked one on top of the other. The medium S fed by one of the medium-feeding containers 81 and 82 is transported along a vertical transport path 83 extending in a substantially vertical direction and a horizontal transport path 84 extending in a substantially horizontal direction and enters the second transfer region TR. Then, the medium S holding the image transferred thereto is transported to a fixing portion of the fixing device 70 through a transport belt 85, and the medium S is ejected to a medium ejection receiver 86 that is provided on the side of the apparatus housing 21.

The medium transport system 80 further includes a branched transport path 87 that branches off downward from a portion of the horizontal transport path 84, the portion being located further downstream than the fixing device 70 in the transport direction of the medium S, and that is capable of flipping over the medium S. The medium S that has been flipped over by the branched transport path 87 returns to the vertical transport path 83 by being transported along a reverse transport path 88 and is transported to the horizontal transport path 84 again. Then, an image is transferred onto the rear surface of the medium S in the second transfer region TR, and the medium S passes through the fixing device 70 and is ejected to the sheet ejection receiver 86.

The medium transport system 80 further includes a position alignment roller 90 that aligns the position of the medium S and supplies the medium S to the second transfer region TR, and the transport paths 83, 84, 87, and 88 are provided with an appropriate number of transport rollers 91.

Furthermore, a manual medium feeder 95 that enables manual feeding of media toward the horizontal transport path 84 is provided on the side of the apparatus housing 21 that is opposite to the side on which the sheet ejection receiver 86 is provided.

—Configuration Example around Transfer Belt Unit—

<Belt Transfer Module>

Figure 6:
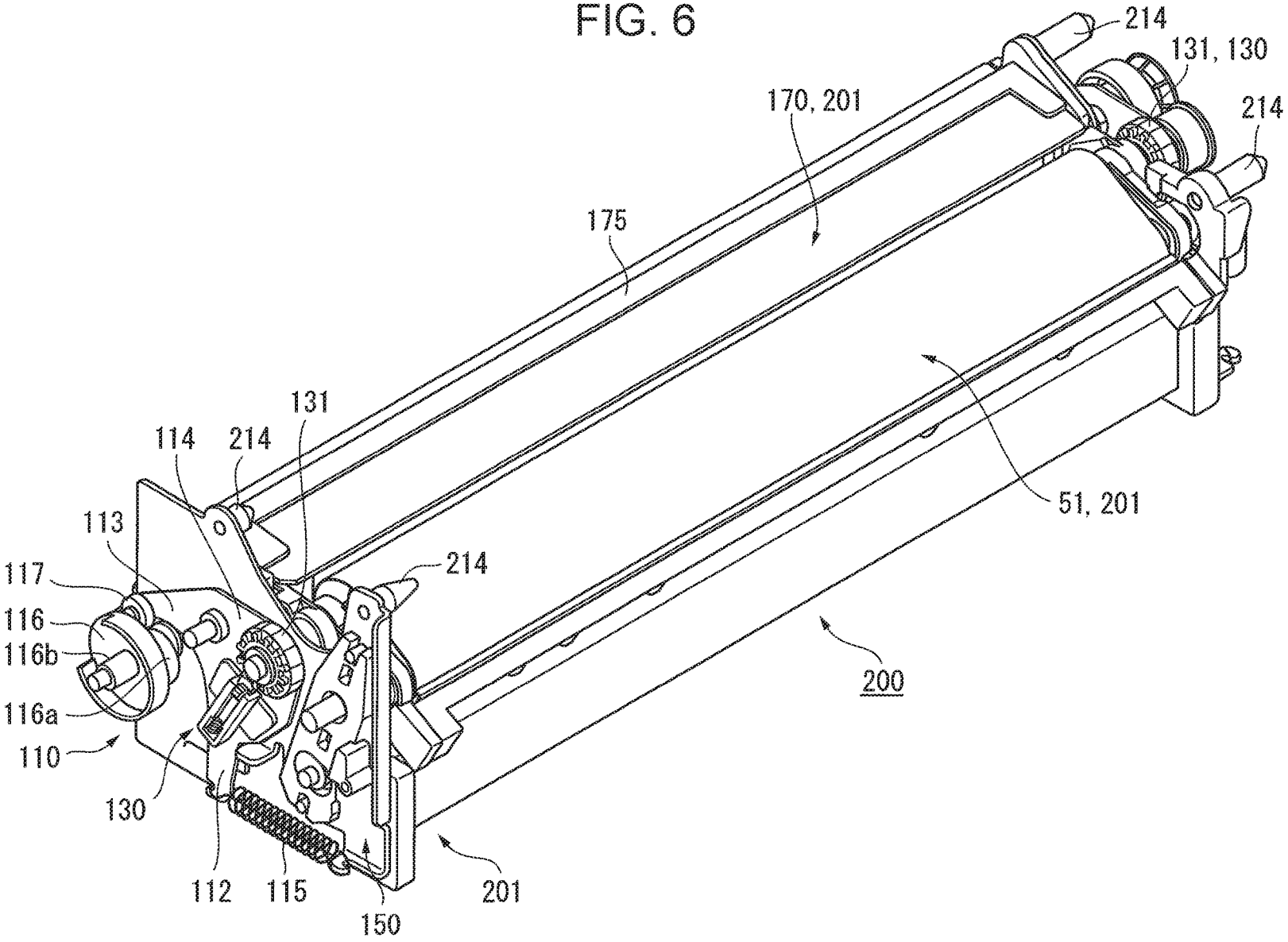
FIG. 6 is a perspective view illustrating a configuration example of a belt transfer module of the second transfer device that is used in the exemplary embodiment.
Figure 7:
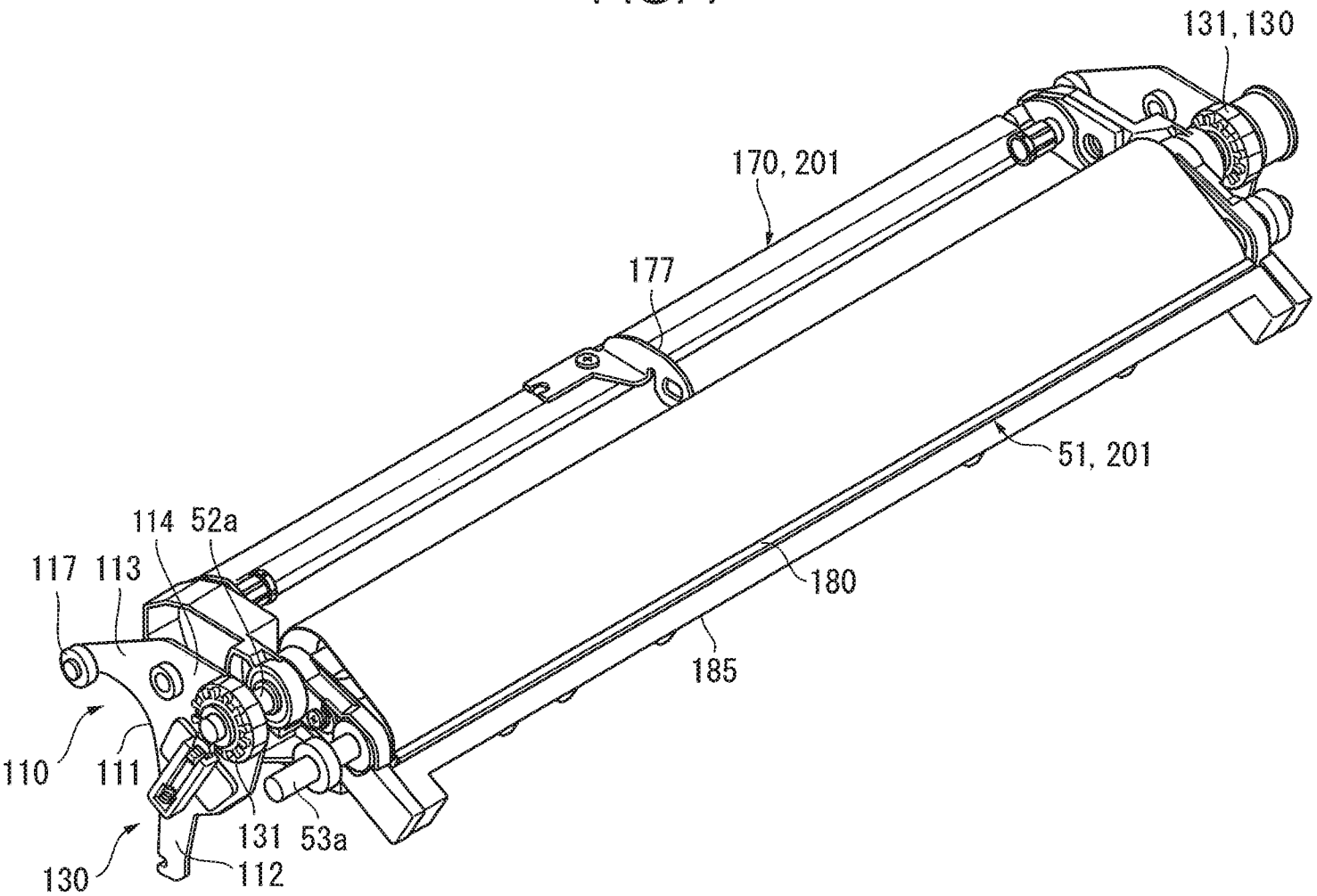
FIG. 7 is a perspective view illustrating swing parts of the belt transfer module illustrated in FIG. 6.
Figure 9:
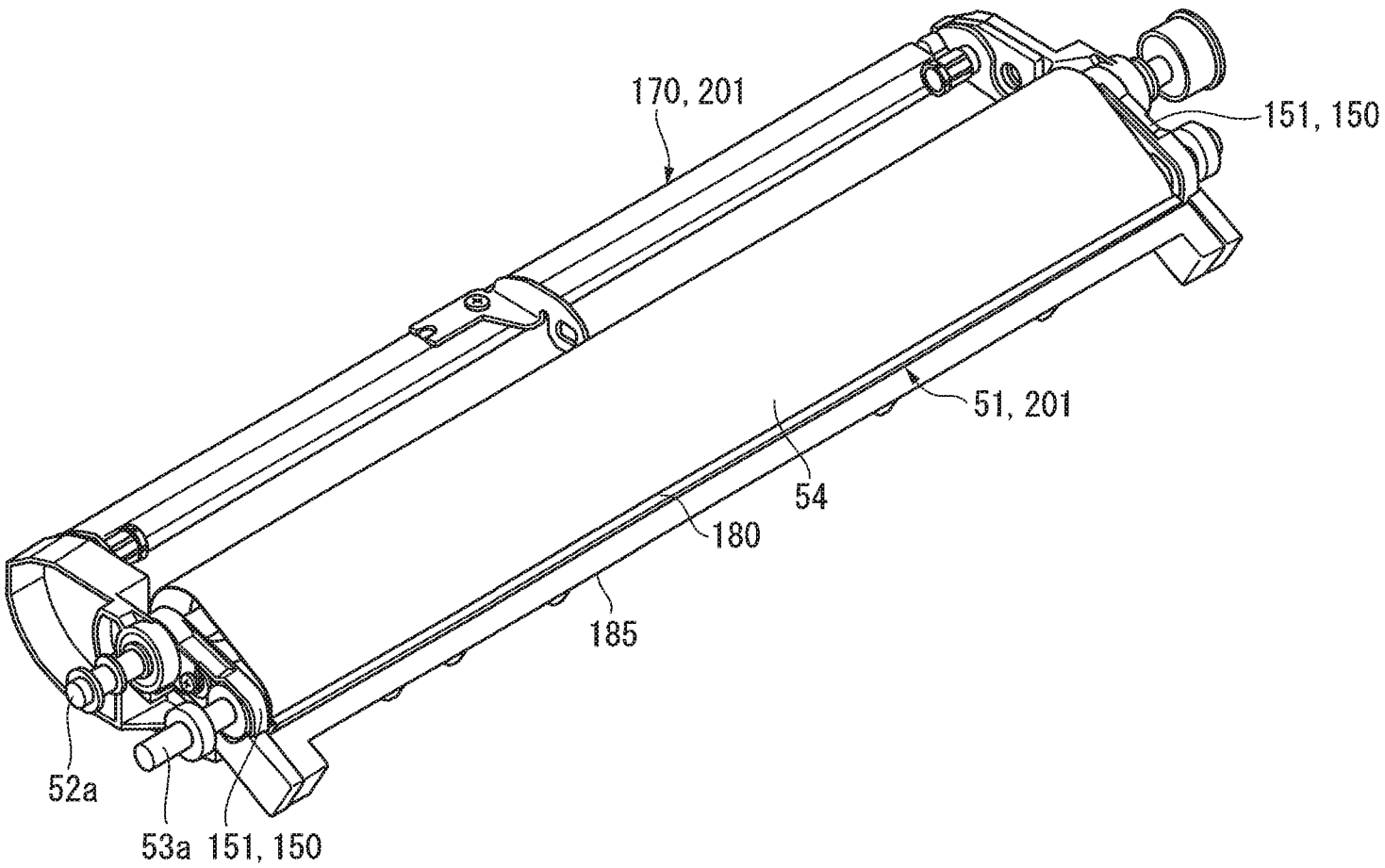
FIG. 9 is a perspective view illustrating the relationship between a transfer belt unit and a cleaning unit, which are included in the swing parts illustrated in FIG. 7.

In the present example, as illustrated in FIG. 6, FIG. 7, and FIG. 9, in the transfer belt unit 51, a cleaning unit 170 is disposed on a portion of the transfer-and-transport belt 54 that corresponds to the first stretching roller 52 (transfer roller 55).

In the present example, the transfer belt unit 51 and the cleaning unit 170 function as swing parts 201 that are swingable with respect to a stationary part 202, and these swing parts 201 and the stationary part 202 will hereinafter be collectively referred to as a belt transfer module 200.

In the present example, the belt transfer module 200 is disposed in such a manner as to be capable of being drawn out from the apparatus housing 21 on the front side, and for example, the belt transfer module 200 is drawn out from the apparatus housing 21 when the belt transfer module 200 undergoes maintenance.

Figure 8:
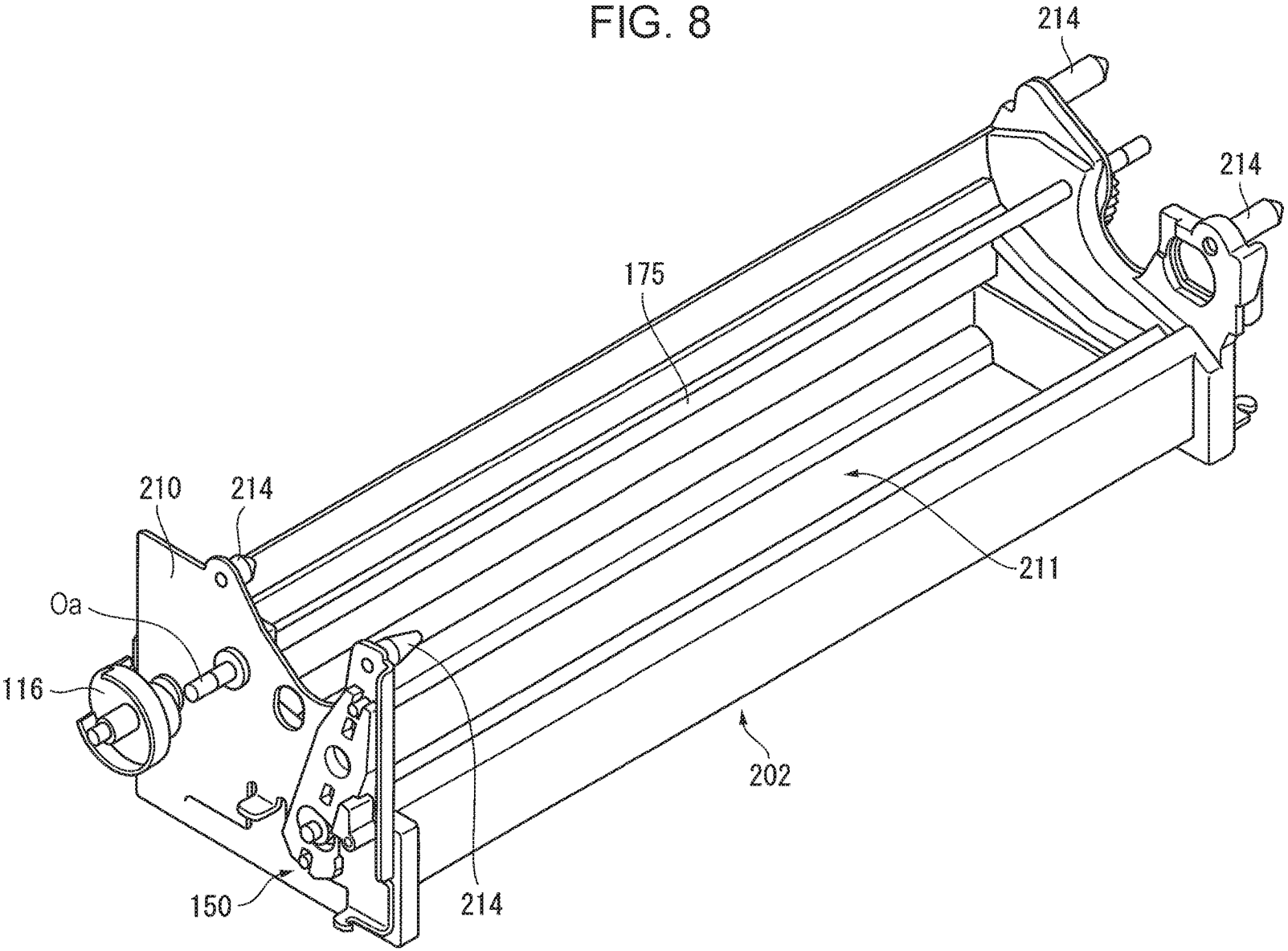
FIG. 8 is a perspective view illustrating a stationary part of the belt transfer module illustrated in FIG. 6.

FIG. 6 illustrates the overall configuration of the belt transfer module 200. FIG. 7 illustrates the swing parts 201. FIG. 8 illustrates the appearance of the stationary part 202.

<Swing Part>

Figure 10:
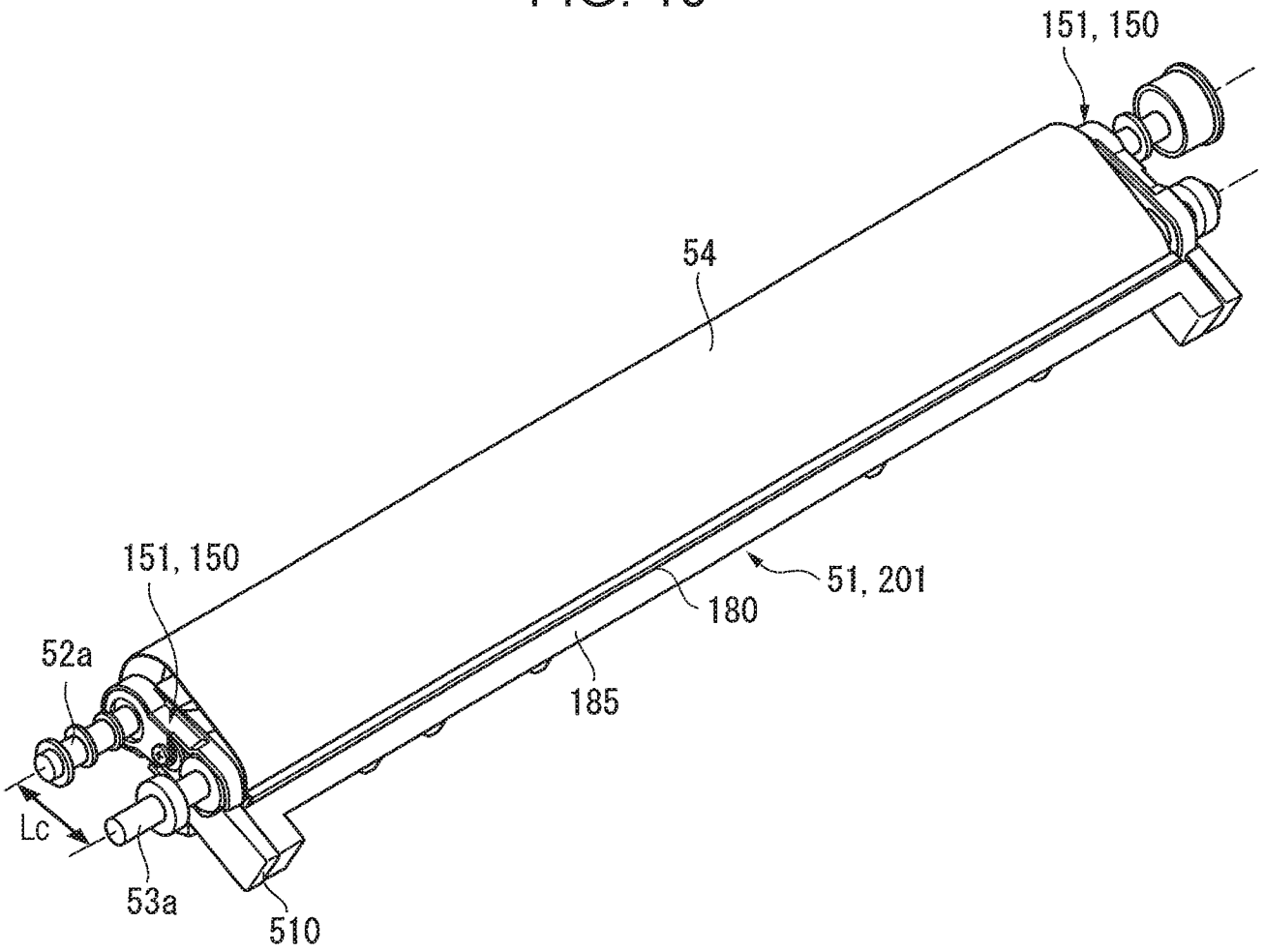
FIG. 10 is a diagram illustrating a configuration example of the transfer belt unit, which is included in the swing parts illustrated in FIG. 7.

In the present example, as illustrated in FIG. 7, FIG. 9, and FIG. 10, the transfer belt unit 51, which is one of the swing parts 201, includes a belt unit housing 510 that integrally holds element components including the transfer-and-transport belt 54, and the belt unit housing 510 is supported so as to be swingable with respect to the stationary part 202.

More specifically, the first stretching roller 52 is used as a driving roller, and the second stretching roller 53 is used as a driven roller. The second stretching roller 53 is supported so as to be swingable while a rotary shaft 52*a* of the first stretching roller 52 serves as a swing fulcrum.

As illustrated in FIG. 7, FIG. 9, FIG. 10, and FIG. 16 to FIG. 19, the cleaning unit 170, which is one of the swing parts 201, includes a cleaning unit housing 171 in which residues deposited on the transfer-and-transport belt 54 are to be accommodated. A cleaning blade 173 is attached to the cleaning unit housing 171 via a support bracket 172, and an end portion of the cleaning blade 173 is positioned so as to be in contact with the transfer-and-transport belt 54 in a widthwise direction of the transfer-and-transport belt 54 that crosses a direction of movement of the transfer-and-transport belt 54.

Figure 16:
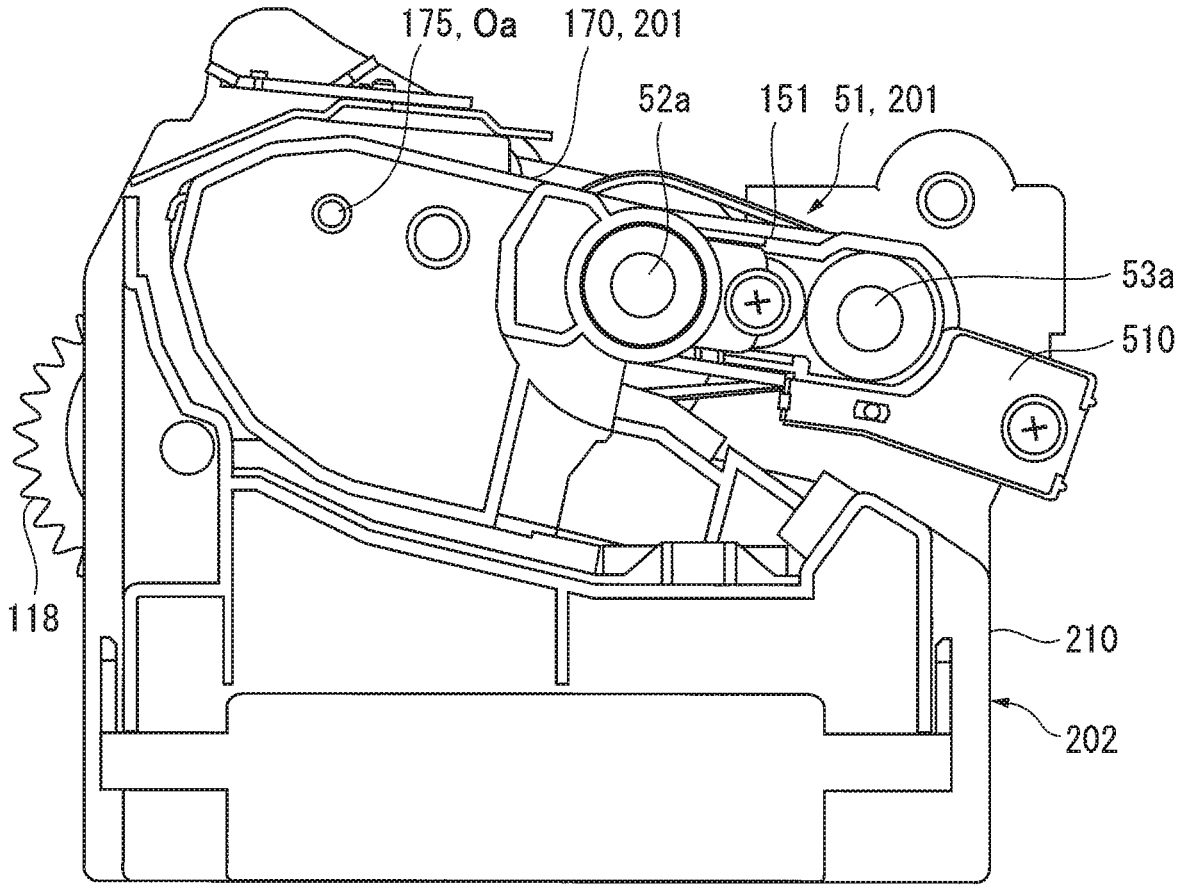
FIG. 16 is a diagram illustrating a relative positional relationship among the transfer belt unit and the peripheral components when the second transfer device according to the exemplary embodiment is located at a set position.
Figure 17:
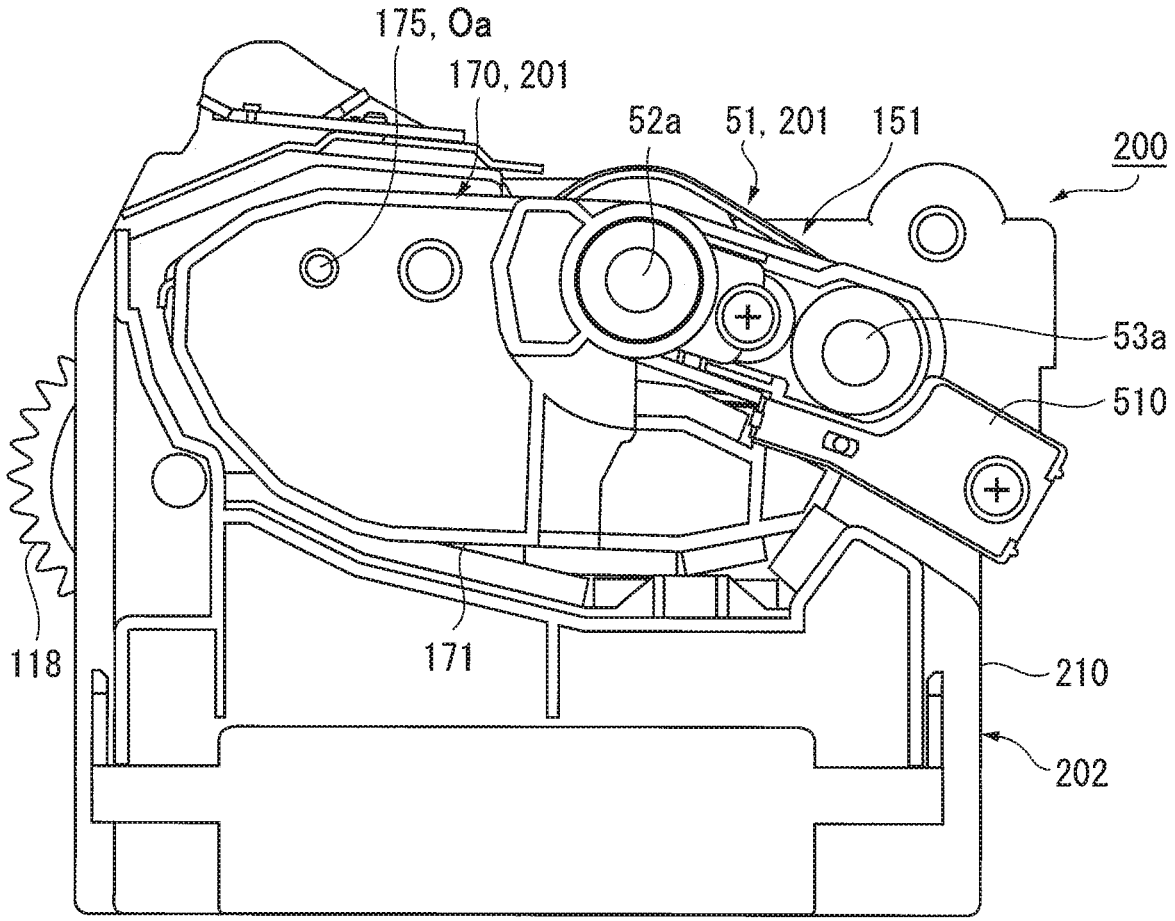
FIG. 17 is a diagram illustrating a relative positional relationship among the transfer belt unit and the peripheral components when the second transfer device is moved to a retract position.
Figure 18:
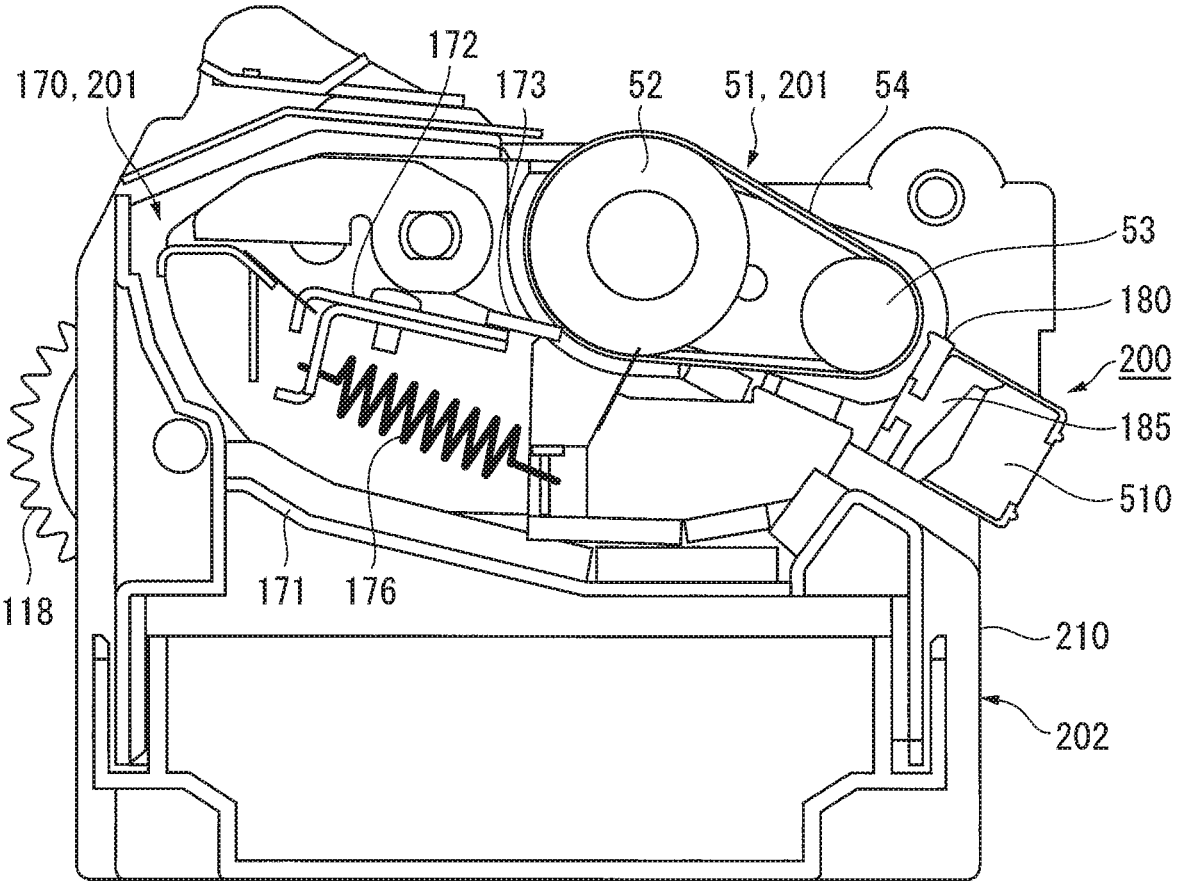
FIG. 18 is a diagram illustrating the behavior of each of the peripheral components of the transfer belt unit when the second transfer device is located at the set position.
Figure 19:
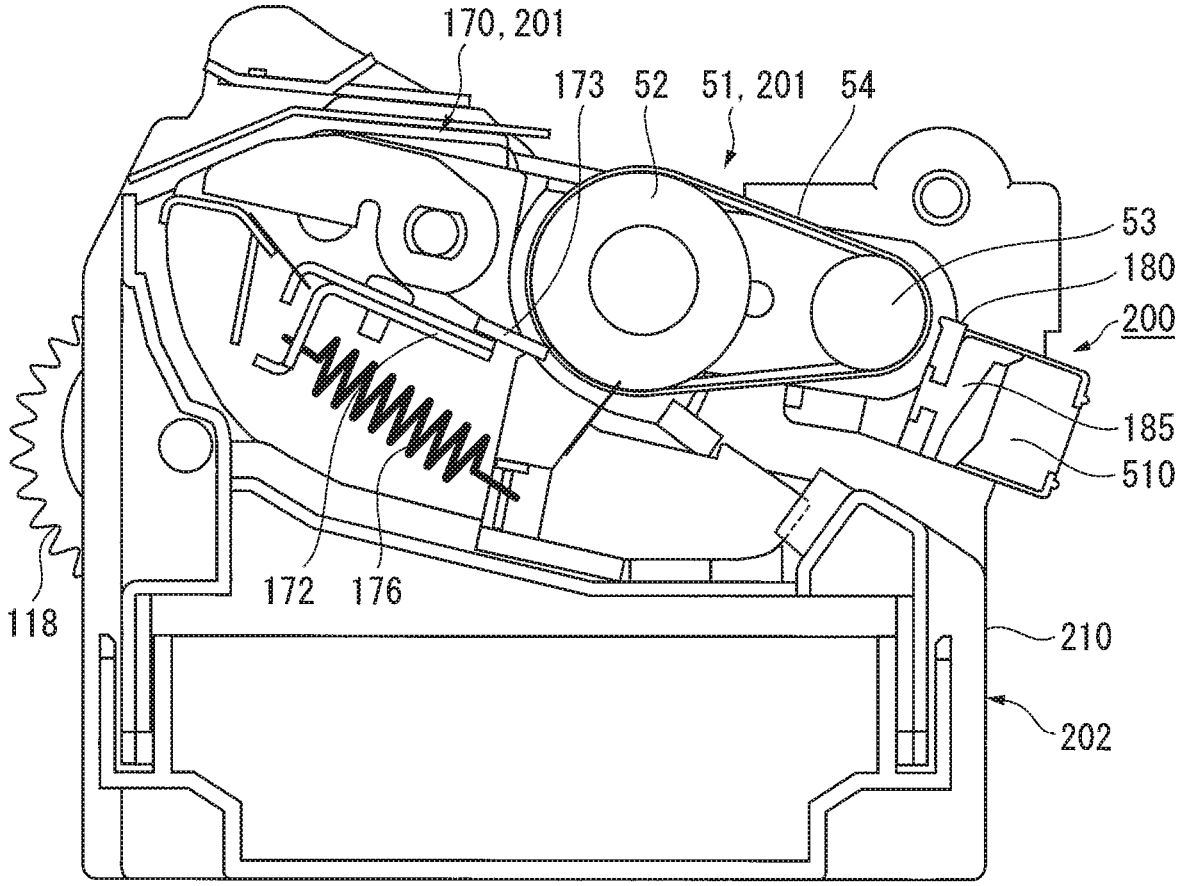
FIG. 19 is a diagram illustrating the behavior of each of the peripheral components of the transfer belt unit when the second transfer device is moved to the retract position.

FIG. 16 and FIG. 17 each illustrate a cross section obtained by cutting the cleaning unit 170 on the near side in a widthwise direction of the belt transfer module 200. FIG. 16 illustrates a state where the retracting mechanisms 110 perform a retracting operation, and FIG. 17 illustrates a state where the retracted state brought by the retracting mechanisms 110 is released (i.e., FIG. 17 illustrates a contact state). FIG. 18 and FIG. 19 each illustrate a cross section obtained by cutting a substantially central portion of the belt transfer module 200 in the widthwise direction. FIG. 18 illustrates a state where the retracting mechanisms 110 perform the retracting operation, and FIG. 19 illustrates a state where the retracted state brought by the retracting mechanisms 110 is released (i.e., FIG. 19 illustrates the contact state).

The cleaning unit housing 171 is supported so as to be swingable with respect to a stationary housing 210 of the stationary part 202 while a stationary shaft 175 that is fixed in place in such a manner as to extend parallel to the axial direction of the first stretching roller 52 of the transfer belt unit 51 serves as a swing fulcrum. In addition, a portion of the cleaning unit housing 171 is rotatably held at the two ends of the rotary shaft 52*a* of the first stretching roller 52 of the transfer belt unit 51.

Furthermore, an urging spring 176 is disposed between the support bracket 172 in the cleaning unit housing 171 and the stationary housing 210 of the stationary part 202, and the contact state between the cleaning blade 173 and the transfer-and-transport belt 54 is maintained by an urging force of the urging spring 176.

In FIG. 7, reference sign 177 denotes a support holder that is disposed substantially at the center of the cleaning unit housing 171 in the longitudinal direction of the cleaning unit housing 171 and that has a through hole through which the stationary shaft 175 extends so that the stationary shaft 175 is supported by the support holder. Thus, as illustrated in FIG. 9, the cleaning unit housing 171 is fixed in place at three points, which are the two ends of the rotary shaft 52*a* of the first stretching roller 52 of the transfer belt unit 51 and the portion in which the stationary shaft 175 and the support holder 177 are in contact with each other.

Peripheral components mounted on the swing parts 201 will be described below.

As illustrated in FIG. 6 and FIG. 7, the swing parts 201 are provided with a static eliminating member (e.g., a static eliminating needle) 180 serving as a static eliminating unit and a plate-shaped guide chute 185 serving as a guiding unit that guides and transports a medium, and the static eliminating member 180 and the guide chute 185 are disposed downstream from the transfer-and-transport belt 54 of the transfer belt unit 51 in the transport direction and are integrally attached to the belt unit housing 510 of the transfer belt unit 51 (see FIG. 10).

Figure 14:
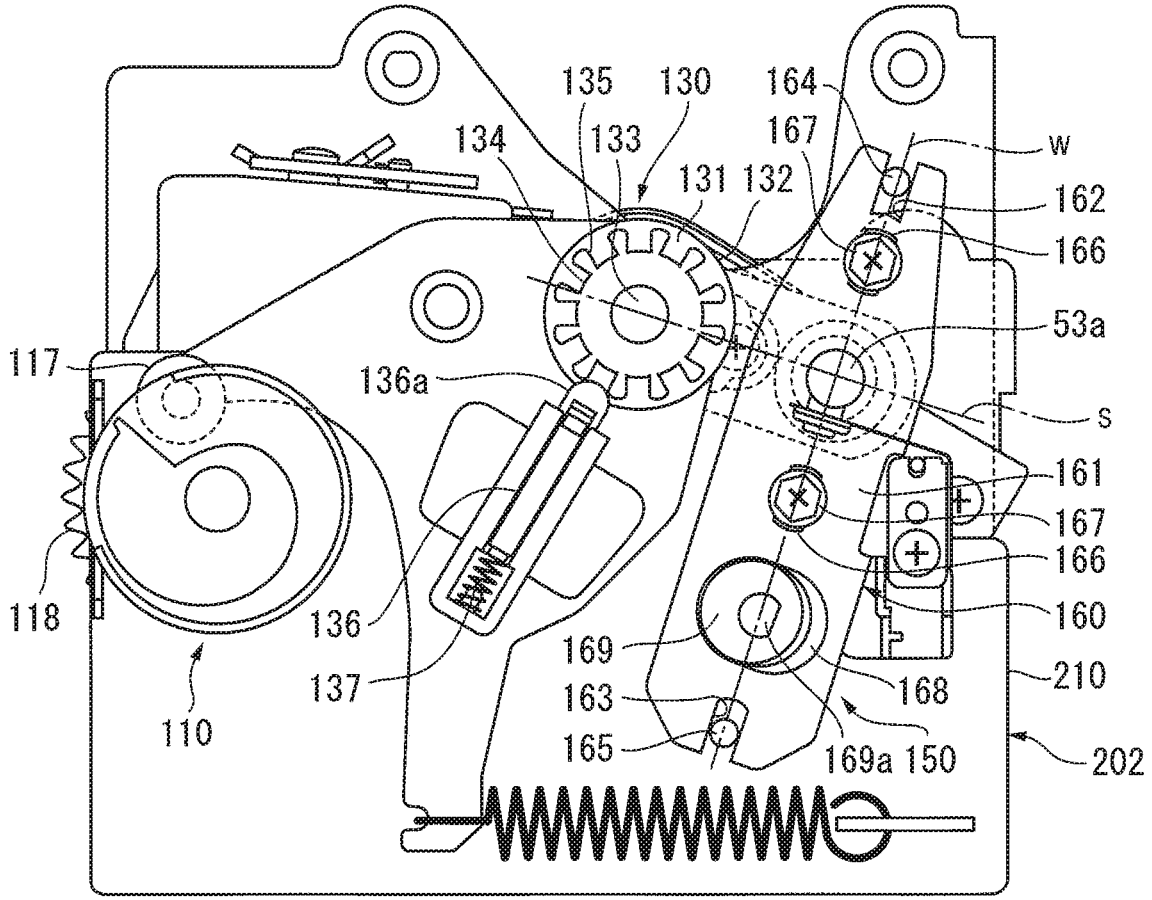
FIG. 14 is a diagram illustrating a first operation example of a nip-pressure adjusting mechanism and a position adjusting mechanism that are used in the exemplary embodiment.

In addition, in the present example, although the second stretching roller 53 is supported so as to be rotatable with respect to the belt unit housing 510 as illustrated in FIG. 6 and FIG. 14, since a system in which the second stretching roller 53 is grounded via the high resistive element 58 is employed, the belt unit housing 510 is provided with a contact 190 that is formed of a metal plate member and that is a portion connected to the high resistive element 58, and a rotary shaft 53*a* of the second stretching roller 53 is positioned in such a manner as to be in contact with the contact 190.

<Stationary Part>

As illustrated in FIG. 6 and FIG. 8, the stationary part 202 includes the stationary housing 210, and in the stationary housing 210, an accommodating-and-receiving portion 211 in which the swing parts 201 are installable is secured. In addition, in order to make the cleaning unit 170 swingable about a predetermined swing fulcrum, in a region in which the cleaning unit 170 is disposed, the stationary shaft 175 is disposed in such a manner as to extend from one of the side walls of the stationary housing 210 to the other of the side walls.

Furthermore, a plurality of positioning pins 214 are formed on upper portions of the side walls of the stationary housing 210, and these positioning pins 214 are inserted into positioning holes (not illustrated) of the intermediate transfer frame 34, so that the intermediate transfer frame 34 is positioned.

—Various Mechanisms Installed around Second Transfer Device—

In the present exemplary embodiment, as illustrated in FIG. 3, the following mechanisms are arranged in the vicinity of the second transfer device 50: the retracting mechanisms 110 that retract the second transfer device 50 from the second transfer region TR, nip-pressure switching mechanisms 120 that switch a nip pressure (contact pressure) Np in the second transfer region TR in accordance with the type of the medium S, nip-pressure adjusting mechanisms 130 that slightly adjust the nip pressure Np in the second transfer region TR, and a position adjusting mechanism 150 that adjusts the position of the transfer belt unit 51.

In FIG. 3, reference sign 101 denotes a medium determination unit that determines the type of the medium S, and for example, the medium determination unit 101 determines a medium that is specified by a user or detects, by using a detector (not illustrated), the media accommodated in the medium-feeding containers 81 and 82 or a medium that is being transported and determines the type of the media S on the basis of a detection signal from the detector.

A control device 100 receives a determination signal from the medium determination unit 101 and sends a control signal to, for example, the nip-pressure switching mechanisms 120.

When medium jam is detected in the second transfer region TR, the control device 100 sends a control signal so as to allow the retracting mechanisms 110 to perform a retracting operation.

Note that, in the present example, as will be described later, a user adjusts the nip-pressure adjusting mechanisms 130 and the position adjusting mechanism 150 manually or by using a jig, and thus, the control device 100 does not control the nip-pressure adjusting mechanisms 130 and the position adjusting mechanism 150.

—Retracting Mechanism—

In the present example, as illustrated in FIG. 6 to FIG. 8, the retracting mechanisms 110 are disposed on the outer sides of the two side walls of the stationary housing 210 of the stationary part 202, which is included in the belt transfer module 200.

In the present example, in each of the retracting mechanisms 110, a link arm 111 having arm portions 112 to 114 extending in three directions is supported so as to be swingable while the stationary shaft 175 of the cleaning unit 170 serves as a swing fulcrum Oa, and an urging spring 115 is hooked on the first arm portion 112 that is one of the three arm portions 112 to 114 of the link arm 111 and that extends downward when viewed from the outside of the stationary housing 210, so that the link arm 111 is urged in the counterclockwise direction (or in the clockwise direction). The second arm portion 113 extending in a direction opposite to the direction in which the link arm 111 is urged by the urging spring 115 is provided with a cam follower 117 that is formed of, for example, a roller, and a cam surface 116*a* of a retracting cam 116 that is a rotary eccentric member is pressed against the cam follower 117 from below. In addition, the third arm portion 114 of the link arm 111 that extends in a direction away from the retracting cam 116 with the swing fulcrum Oa interposed therebetween supports the rotary shaft 52*a* of the first stretching roller 52 (transfer roller 55) of the transfer belt unit 51 such that the rotary shaft 52*a* is rotatable.

Note that, in the present example, a cam shaft 116*b* of one of the retracting cams 116 extends to the rear side of the belt transfer module 200, and the rear side retracting cam 116, which is the other of the retracting cams 116, and a retracting gear 118 (see FIG. 12), which is an example of a drive transmission mechanism, are provided on the rear side of the cam shaft 116*b*. A driving force is transmitted to the retracting gear 118 from a driving source (not illustrated).

As described above, in the present example, the retracting mechanisms 110 retractably support the two ends of the rotary shaft 52*a* of the first stretching roller 52 of the transfer belt unit 51.

—Nip-Pressure Switching Mechanism—

Figure 5:
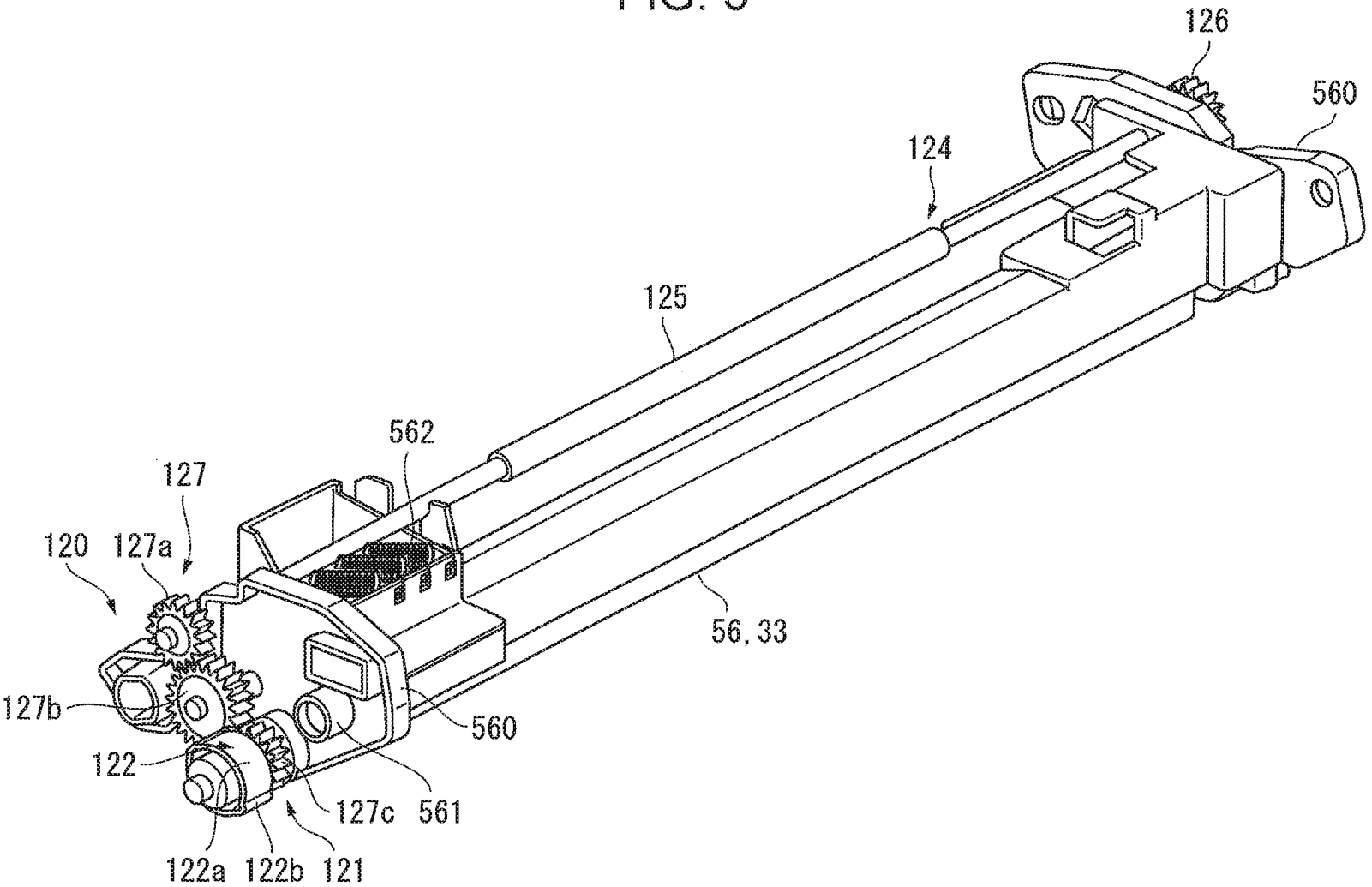
FIG. 5 is a diagram illustrating the details of a nip-pressure switching mechanism that is used in the exemplary embodiment.

In the present exemplary embodiment, as illustrated in FIG. 4 and FIG. 5, the nip-pressure switching mechanisms 120 displace a rotary shaft 56*a* of the counter roller 56 (corresponding to the stretching roller 33) of the second transfer device 50.

In particular, in the present example, each of the nip-pressure switching mechanisms 120 functions as a second nip-pressure adjusting mechanism that corresponds to the second contact adjusting unit and that adjusts the nip pressure (contact pressure) Np in the second transfer region TR more roughly than the nip-pressure adjusting mechanisms 130 (described later) do.

In the present example, a roller holder 560 is provided so as to cover the two ends of the counter roller 56 in the axial direction of the counter roller 56 and the upper side of the counter roller 56, and the two ends of the rotary shaft 56*a* of the counter roller 56 are rotatably supported by the two side walls of the roller holder 560 in the axial direction of the roller holder 560 with bearing members 561 interposed therebetween. Each of the bearing members 561 is supported by the roller holder 560 so as to be capable of coming into and out of contact with the transfer belt unit 51. In addition, urging springs 562 are disposed between the roller holder 560 and the bearing members 561, and the counter roller 56 is urged toward the transfer belt unit 51 by the urging springs 562.

In the present example, in the nip-pressure switching mechanisms 120, switching cams 121 each of which serves as an eccentric rotary member are supported so as to be coaxial with the two ends of the rotary shaft 56*a* of the counter roller 56, and each of the switching cams 121 has a cam surface 122 that is formed in such a manner that the outer diameter of the switching cam 121 varies in the circumferential direction of the switching cam 121. In the present example, each of the cam surfaces 122 has a smaller-diameter portion 122*a* and a larger-diameter portion 122*b* formed at a position that is displaced from the smaller-diameter portion 122*a* by 180 degrees in the circumferential direction of the corresponding switching cam 121, and the smaller-diameter portion 122*a* and the larger-diameter portion 122*b* are smoothly connected to each other.

A driving force is transmitted to each of the switching cams 121 from a driving source (not illustrated) via a drive transmission mechanism 124 such that the switching cams 121 rotate synchronously with each other by a predetermined amount.

In the present example, the driving source (not illustrated) is disposed on the rear side (far side) of the apparatus housing 21. In the drive transmission mechanism 124, a transmission shaft 125 that extends from the rear side (far side) to the front side (near side) is rotatably supported by the two side walls of the roller holder 560, and a driven gear 126 is fixed to the rear side (far side) of the transmission shaft 125. A row of transmission gears 127 (three transmission gears are used in the present example) are arranged on the front side (near side) of the transmission shaft 125, and the switching cam 121 on the front side (near side) is driven so as to rotate via the row of transmission gears 127. The row of transmission gears 127 includes a transmission gear 127*a* that is disposed coaxial with the transmission shaft 125, the lowermost transmission gear 127*c* that is disposed coaxial with the switching cam 121, and an intermediate transmission gear 127*b* that is interposed between the transmission gears 127*a* and 127*c*. Note that, as the drive transmission mechanism 124, a driving force may be transmitted to the switching cam 121 that is disposed on the rear side (far side) from the driven gear 126 via a row of transmission gears (not illustrated).

—Nip-Pressure Adjusting Mechanism—

In the present example, as illustrated in FIG. 4 to FIG. 6, FIG. 14, and FIG. 15, the nip-pressure adjusting mechanisms 130 are provided on the front side and the rear side of the belt transfer module 200.

Here, the nip-pressure adjusting mechanism 130 that is disposed on the front side of the belt transfer module 200 will be described, and the description of the nip-pressure adjusting mechanism 130 disposed on the rear side will be omitted as it is similar to the nip-pressure adjusting mechanism 130 on the front side.

In the present example, as illustrated in FIG. 4, FIG. 6, FIG. 7, FIG. 14, and FIG. 15, in the nip-pressure adjusting mechanism 130, one of slight adjustment cams 131 is disposed coaxial with, on the front side, the rotary shaft 52*a* of the first stretching roller 52 (transfer roller 55) of the transfer belt unit 51, and in the present example, the slight adjustment cam 131 is disposed in such a manner as to be exposed at the outer surface of the link arm 111 of the retracting mechanisms 110.

Figure 15:
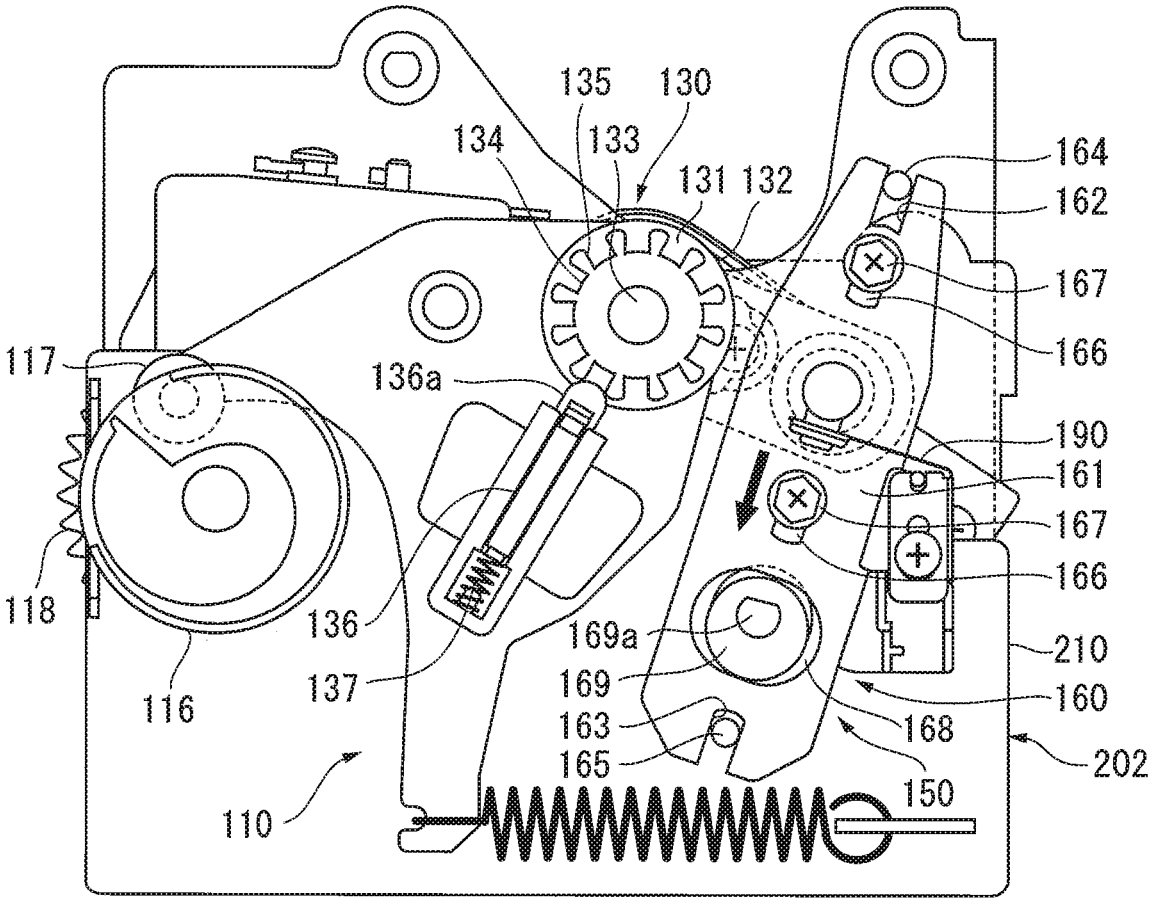
FIG. 15 is a diagram illustrating a second operation example of the nip-pressure adjusting mechanism and the position adjusting mechanism.

Note that FIG. 14 and FIG. 15 each illustrate a state where the swing parts 201 of the belt transfer module 200 are separated from the intermediate transfer body 30 by the retracting mechanisms 110 and are located at retract positions.

In the present example, each of the slight adjustment cams 131 has a cam surface 132, and the cam surface 132 has a minimum-diameter portion and a maximum-diameter portion such that the outer diameter of the slight adjustment cam 131 gradually varies in the circumferential direction of the slight adjustment cam 131. These cam surfaces 132 are in contact with the cam surfaces 122 of the switching cams 121 of the nip-pressure switching mechanisms 120.

A position control ring 133 for controlling an angular position is disposed on the near side of each of the slight adjustment cams 131. In the present example, the position control rings 133 each have an annular ring body 134 and a plurality of recesses 135 that are formed at a predetermined pitch in the circumferential direction of the annular ring body 134. Here, the number of the recesses 135 may be suitably selected, and for example, when there are twelve recesses 135, the recesses 135 may be formed at a pitch of 30 degrees. In addition, although the amount of change in the outer diameter of each of the slight adjustment cams 131 may be suitably selected, the outer diameter may be set to increase by an amount Δd (e.g., 50 μm to 100 μm) for each recess 135 in the circumferential direction.

In the present example, in each of the retracting mechanisms 110, a stopper rod 136 that serves as a stopping unit is provided below the position control ring 133 on the outer surface of the link arm 111. each of the stopper rods 136 has a hemispherical protrusion 136*a* formed at an end thereof and is pressed by a pressing spring 137 such that the hemispherical protrusion 136*a* is pressed toward one of the recesses 135 of the corresponding position control ring 133. In the present example, the hemispherical protrusion 136*a* is pressed so as to close the start of one of the recesses 135, and for example, when a user appropriately rotates the position control rings 133 manually or by using a jig, along with movements of the recesses 135 of the position control rings 133, the stopper rods 136 are advanced and retracted repeatedly while being pressed by the pressing springs 137.

Note that the nip-pressure adjusting mechanism 130 provided on the rear side is configured substantially similar to the nip-pressure adjusting mechanism 130 provided on the front side.

—Position Adjusting Mechanism—

In the present example, as illustrated in FIG. 4 to FIG. 6, FIG. 10, FIGS. 11A to 11C, FIG. 14, and FIG. 15, the position adjusting mechanism 150 is provided so as to be adjustable on the front side of the belt transfer module 200.

In other words, the position adjusting mechanism 150 includes position locking mechanisms 151 that are provided at the two ends of the first and second stretching rollers 52 and 53 of the transfer belt unit 51 and that allow rotational operations of the first and second stretching rollers 52 and 53 while keeping the distance between the centers of these rollers constant and a displacement mechanism 160 that causes the second end of the second stretching roller 53 in the axial direction of the second stretching roller 53 (the front end of the rotary shaft 53*a*) to swing while the second end of the first stretching roller 52 in the axial direction of the first stretching roller 52 (the front end of the rotary shaft 52*a* in the present example) serves as a fulcrum.

Here, as illustrated in FIG. 9 to FIG. 11A, each of the position locking mechanisms 151 includes restricting rollers 152 and 153. The restricting rollers 152 are provided at the two ends of the first stretching roller 52 in such a manner as to be coaxial with the first stretching roller 52, and the restricting rollers 153 are provided at the two ends of the second stretching roller 53 in such a manner as to be coaxial with the second stretching roller 53. Each of the position locking mechanisms 151 further includes a space adjustment roller 154 that is interposed between the restricting roller 152 and the restricting roller 153 in such a manner as to be in contact with the restricting rollers 152 and 153 and a holding frame 155 that holds the restricting roller 152, the restricting roller 153, and the space adjustment roller 154 such that these rollers are rotatable and such that the axes of these rollers are aligned in a straight line.

Figure 11A:
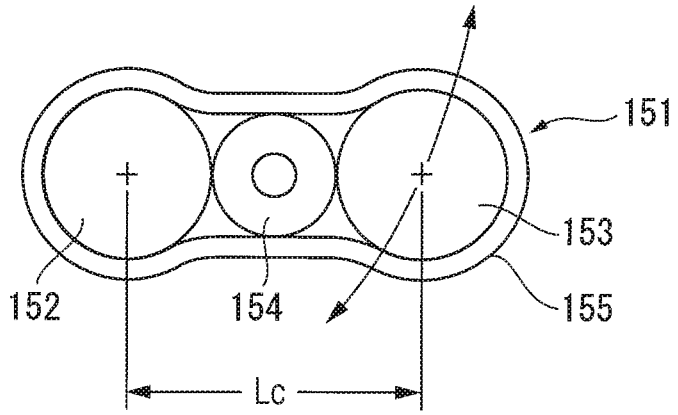
FIG. 11A is a diagram illustrating an example of one of position locking mechanisms of the transfer belt unit.
Figure 11B:
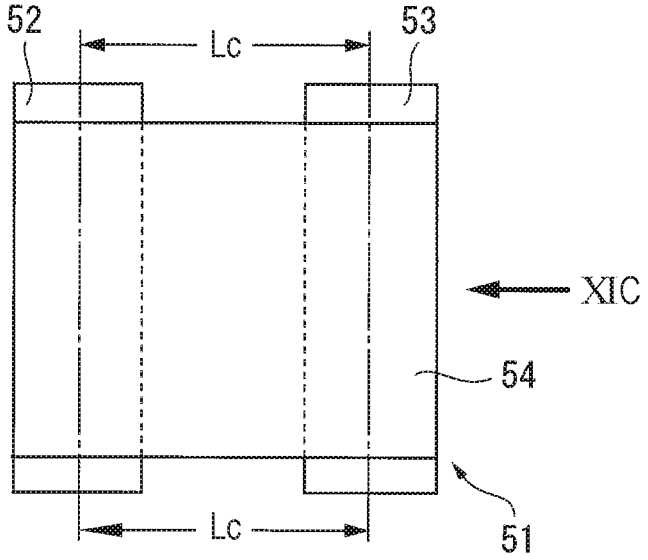
FIG. 11B is a diagram schematically illustrating a locking state obtained by the position locking mechanisms of the transfer belt unit.

In this case, as illustrated in FIGS. 11A and 11*b*, the distance between the center of the first stretching roller 52 and the center of the second stretching roller 53 is a fixed dimension Lc on both the front side (near side) and the rear side (far side).

As illustrated in FIG. 6, FIG. 8, FIG. 14, and FIG. 15, the displacement mechanism 160 is provided on the front side (near side) in the direction in which the rotary shaft 53*a* of the second stretching roller 53 extends.

In the present example, the displacement mechanism 160 is disposed on the outside of the side wall of the stationary housing 210 of the stationary part 202, which is included in the belt transfer module 200, the side wall being located on the near side, and causes the second end of the second stretching roller 53 in the axial direction of the second stretching roller 53 to be advanced and retracted in a direction w that is substantially perpendicular to a reference line s connecting the axial center of the first stretching roller 52 and the axial center of the second stretching roller 53.

More specifically, as illustrated in FIG. 14, the displacement mechanism 160 includes a long displacement adjustment plate 161 that extends in the direction w substantially perpendicular to the reference line s. The rotary shaft 53*a* of the second stretching roller 53 is rotatably supported by the displacement adjustment plate 161, and guiding grooves 162 and 163 each having a substantially U shape or an inverted U shape are formed in both upper and lower end portions of the displacement adjustment plate 161. In contrast, guiding protrusions 164 and 165 are formed on the outside of the corresponding side wall of the stationary housing 210 so as to correspond to the guiding grooves 162 and 163, respectively, and so as to be slidably engaged with the guiding grooves 162 and 163, respectively.

The displacement adjustment plate 161 has a plurality of (two in the present example) fixing holes 166 that are formed to be aligned in the longitudinal direction of the displacement adjustment plate 161. Each of the fixing holes 166 is elongated in a direction of movement of the displacement adjustment plate 161, and a stopper 167 such as a screw is inserted into each of the fixing holes 166 and fixed to the stationary housing 210. Thus, when the stoppers 167 are tightened, the heads of the stoppers 167 are brought into contact with the displacement adjustment plate 161, and the displacement adjustment plate 161 is fixed in place so as to be immovable. When the stoppers 167 are loosened, the displacement adjustment plate 161 becomes movable along the guiding grooves 162 and 163.

A cam-follower hole 168 is formed in a lower portion of the displacement adjustment plate 161, the lower portion being located above the lower guiding groove 163, and is elongated in the transverse direction crossing the longitudinal direction of the displacement adjustment plate 161, and a displacement adjustment cam 169 is accommodated in the cam-follower hole 168. The displacement adjustment cam 169 is formed as an eccentric cam having a substantially oval external shape with respect to a rotary shaft 169*a*. The displacement adjustment cam 169 rotates as a result of a user rotating the rotary shaft 169*a* manually or by using a jig in a state where a fixed state brought by the stoppers 167 is released, so that the cam-follower hole 168 is moved upward or downward.

Figure 11C:
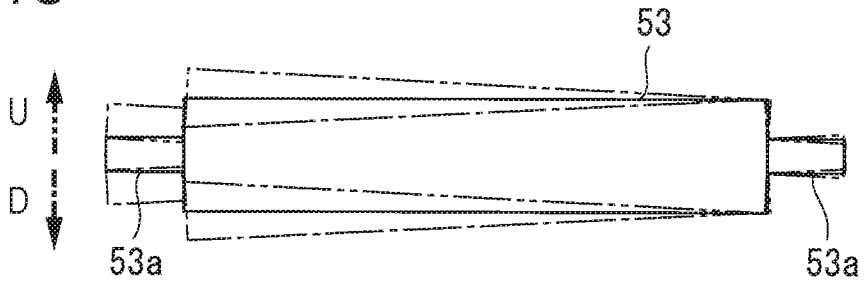
FIG. 11C is a diagram illustrating the behavior of a separation roller, which is a second stretching roller of the transfer belt unit.

Thus, in the present example, since the displacement adjustment plate 161 is suitably moved in the direction w, as illustrated in FIG. 11C, the front side position of the rotary shaft 53*a* of the second stretching roller 53 held by the displacement adjustment plate 161 is displaced upward (U) or downward (D) in the direction w.

Note that FIG. 15 illustrates a state where the displacement adjustment plate 161 has been moved downward as indicated by an arrow from a reference position illustrated in FIG. 14.

Operation of the image forming apparatus according to the present exemplary embodiment will now be described.

—Retracting Operation by Retracting Mechanism—

Figure 12:
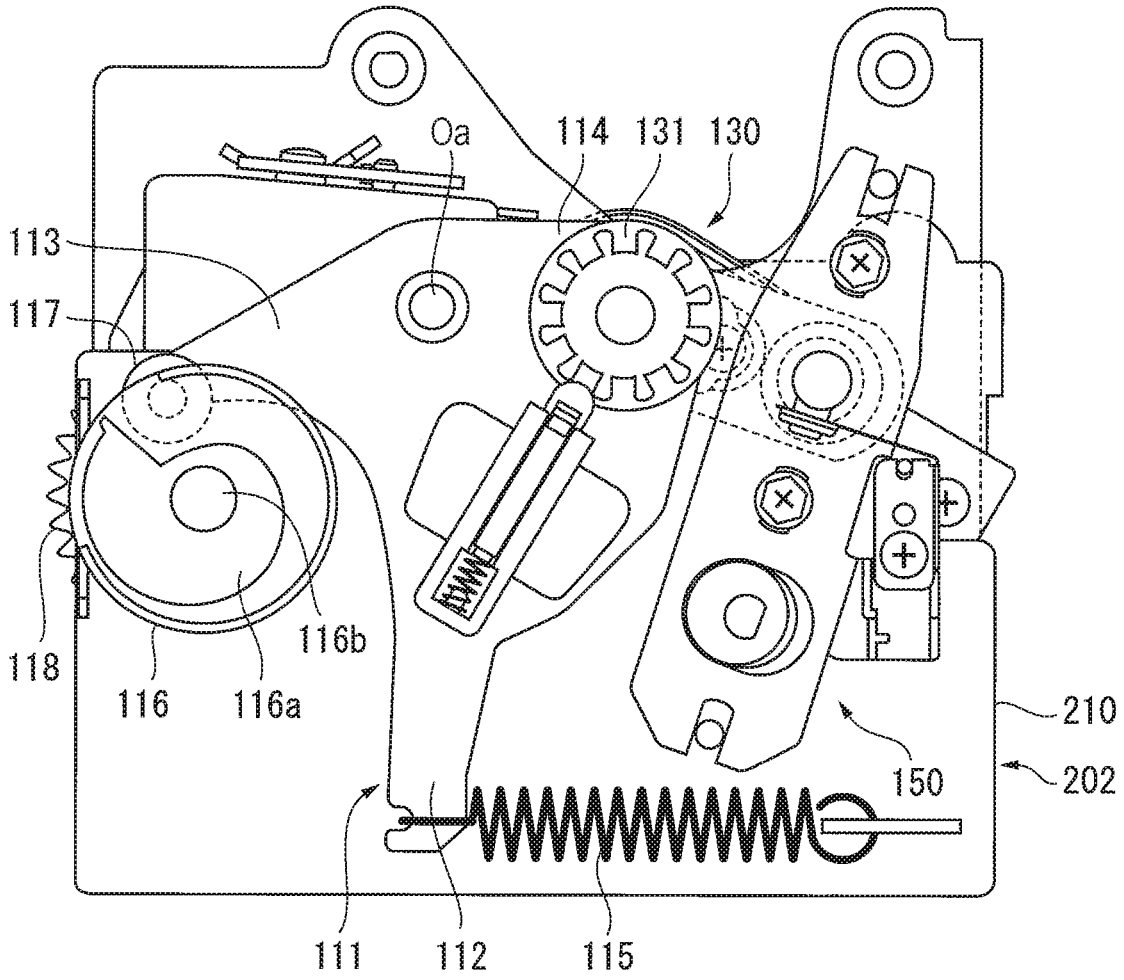
FIG. 12 is a diagram illustrating a first operation example of one of retracting mechanisms used in the exemplary embodiment.
Figure 13:
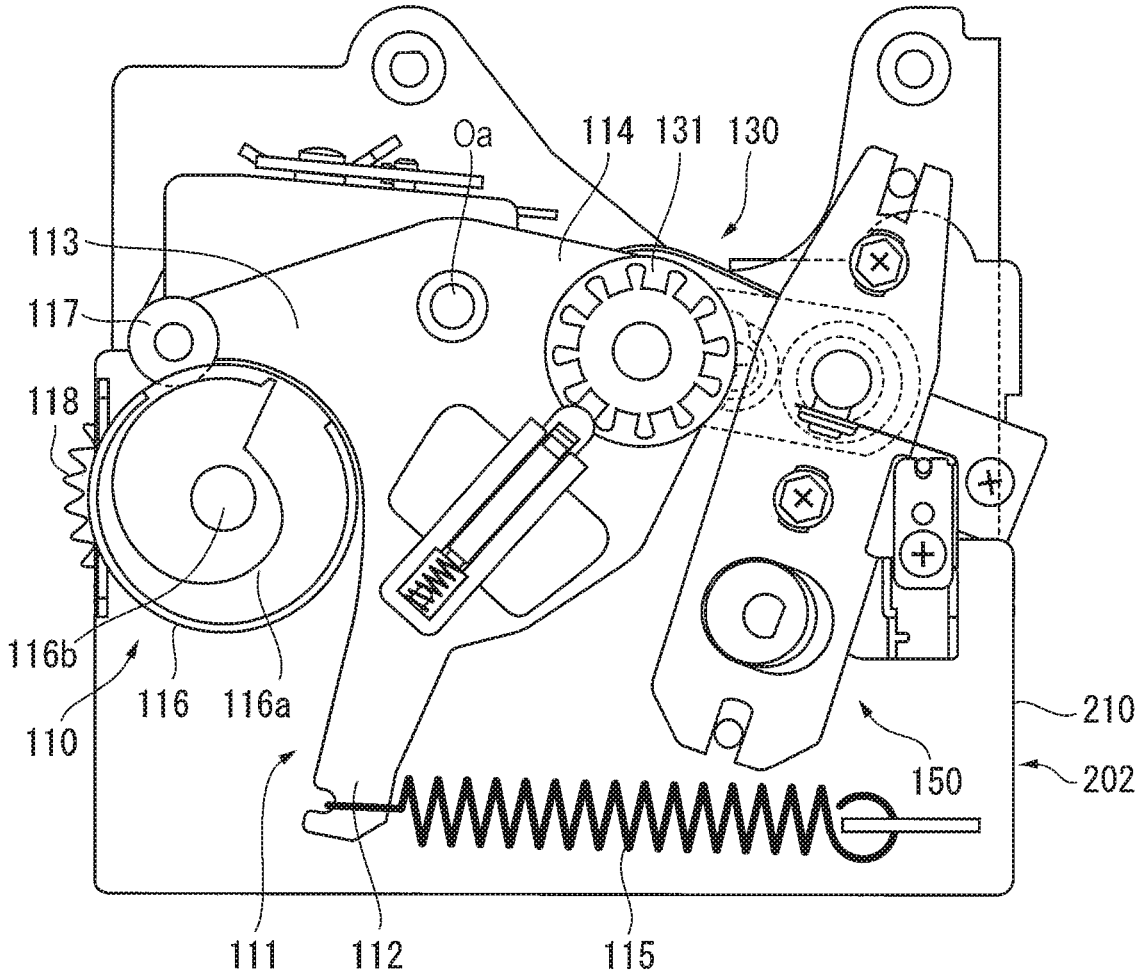
FIG. 13 is a diagram illustrating a second operation example of the retracting mechanism.

In the present exemplary embodiment, the retracting mechanisms 110 are provided on either side of the belt transfer module 200 and operate synchronously with each other. In this case, when retracting the belt transfer module 200, as illustrated in FIG. 12 and FIG. 13, the retracting cams 116 may be rotated in a predetermined direction. When each of the retracting cams 116 is rotated in a direction in which the outer diameter of the cam surface 116*a* of the retracting cam 116 increases, and the outer diameter reaches the maximum diameter corresponding to the retract position, the second arm portion 113 of the link arm 111 is pushed upward. Along with this, the third arm portion 114 is moved downward, and the bearing portion of the first stretching roller 52 (transfer roller 55) of the transfer belt unit 51 is moved away from the second transfer region TR and reaches a predetermined retract position (see FIG. 12).

In the case where the retracted state brought by the retracting mechanisms 110 is released, when each of the retracting cams 116 is rotated to a position where the cam surface 116*a* of the retracting cam 116 has the minimum outer diameter, the link arm 111 is urged by the urging force of the urging spring 115, and the second arm portion 113 is moved downward. Along with this, the bearing portion of the first stretching roller 52 (transfer roller 55) of the transfer belt unit 51 reaches a contact position where the bearing portion is in contact with the second transfer region TR (see FIG. 13).

—Switching of Nip Pressure by Nip-Pressure Switching Mechanism—

Figure 20A:
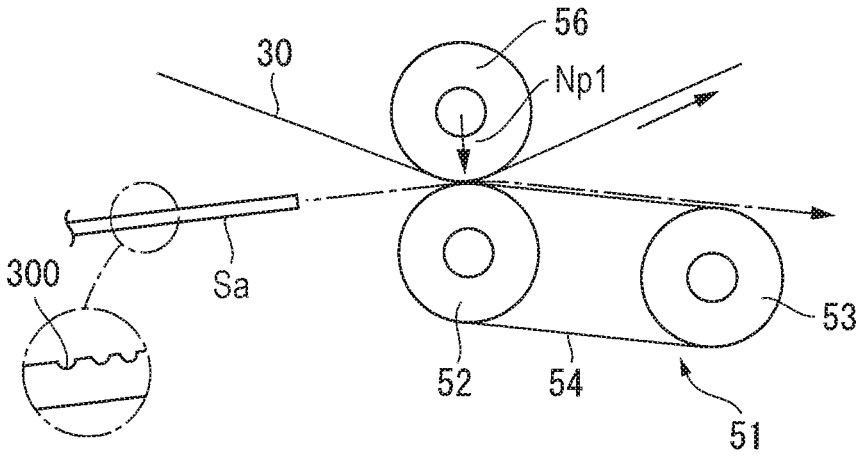
FIG. 20A is a diagram illustrating a state in which a nip pressure in a second transfer region is selected on the condition that a medium is a special medium such as embossed paper.

In the case where various types of the media S are used in the present exemplary embodiment, when a medium Sa, such as an embossed sheet, that has large surface irregularities is used as illustrated in FIG. 20A, if a second transfer condition (nip pressure) similar to that for a medium Sb, such as a normal sheet, is employed, there is a concern that it may be difficult to transfer an image portion onto depressions 300 formed on the surface of the medium Sa.

Thus, in the present exemplary embodiment, when the medium Sa, such as an embossed sheet, that has a rough surface is used, the control device 100 determines the medium Sa on the basis of a determination signal from the medium determination unit 101 and sends a predetermined control signal to the nip-pressure switching mechanisms 120.

Then, the nip-pressure switching mechanisms 120 may suitably rotate the switching cams 121 and may bring, for example, the smaller-diameter portions 122*a* of the cam surfaces 122 of the switching cams 121 into contact with the cam surfaces 132 of the slight adjustment cams 131 of the nip-pressure adjusting mechanisms 130.

In this state, a nip pressure Np1 between the first stretching roller 52 (transfer roller 55) of the transfer belt unit 51 and the counter roller 56 increases, and a second transfer condition that is suitable for the medium Sa is obtained. As a result, an image is also transferred onto the depressions 300 of the medium Sa in the second transfer process.

Figure 20B:
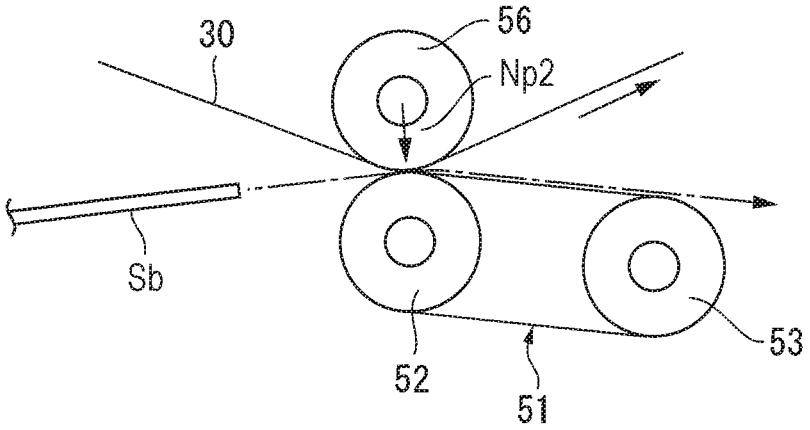
FIG. 20B is a diagram illustrating a state in which the nip pressure in the second transfer region is switched on the condition that a medium is a normal medium.

In contrast, when the medium Sb such as a normal sheet is used, as illustrated in FIG. 20B, the larger-diameter portions 122*b* of the cam surfaces 122 of the switching cams 121 may be caused, by the control device 100, to come into contact with the cam surfaces 132 of the slight adjustment cams 131 of the nip-pressure adjusting mechanisms 130.

In this state, a nip pressure Np2 between the first stretching roller 52 (transfer roller 55) of the transfer belt unit 51 and the counter roller 56 is set to be low, and a second transfer condition that is suitable for the medium Sb is obtained.

—Slight Adjustment by Nip-pressure Adjusting Mechanism—

Slight adjustment of nip pressure that is performed by the nip-pressure adjusting mechanisms 130 will now be described.

Figure 21A:
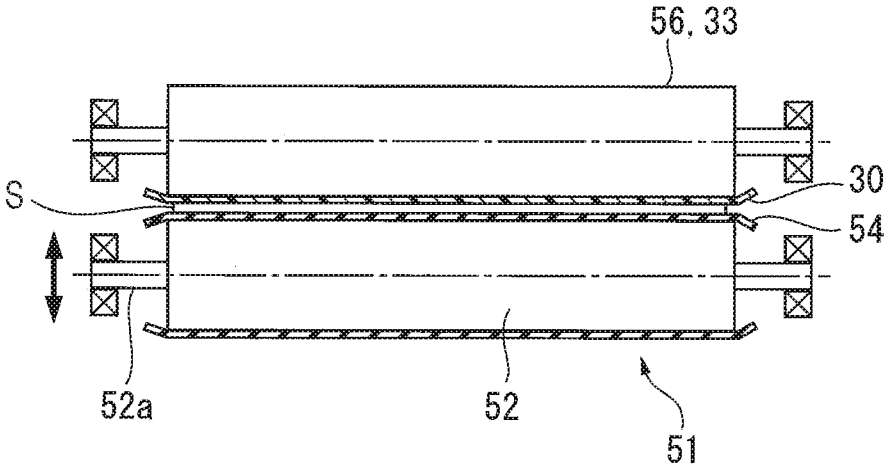
FIG. 21A is a diagram schematically illustrating an operation example of the nip-pressure adjusting mechanism.

In the present example, as illustrated in FIG. 21A, the nip-pressure adjusting mechanism 130 that is located on the front side is capable of slightly adjusting the front side position of the rotary shaft 52*a* of the first stretching roller 52 of the transfer belt unit 51.

Figure 21B:
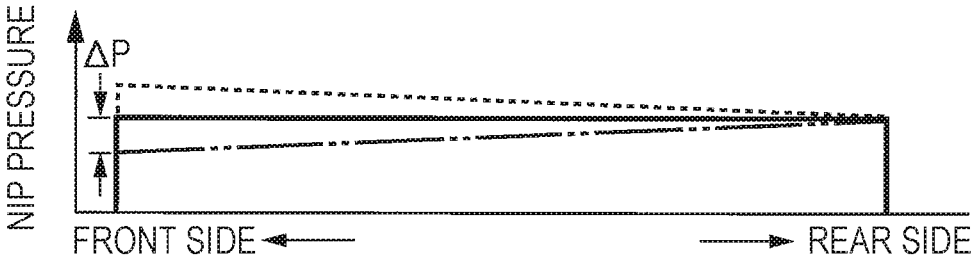
FIG. 21B is a diagram illustrating a method of adjusting a nip pressure by using the nip-pressure adjusting mechanism.

In this case, since the front end of the rotary shaft 52*a* of the first stretching roller 52 is swung while the rear end of the rotary shaft 52*a* serves as a fulcrum, for example, when the nip pressure in the second transfer region TR on the front side is higher than that on the rear side as indicated by a dotted line in FIG. 21B, or when the nip pressure in the second transfer region TR on the front side is lower than that on the rear side as indicated by a two-dot chain line in FIG. 21B, the front end of the rotary shaft 52*a* of the first stretching roller 52 may be suitably displaced.

Note that the nip-pressure adjusting mechanism 130 that is located on the rear side operates in a manner substantially similar to the nip-pressure adjusting mechanism 130 that is located on the front side and is capable of slightly adjusting the rear side position of the rotary shaft 52*a* of the first stretching roller 52 of the transfer belt unit 51 by causing the rear end of the rotary shaft 52*a* of the first stretching roller 52 to swing while the front end of the rotary shaft 52*a* serves as a fulcrum.

In particular, in the present exemplary embodiment, not only the first stretching roller 52 (functioning as the transfer roller 55) of the transfer belt unit 51 but also the transfer-and-transport belt 54 are made of an elastic material, and thus, the first stretching roller 52 and the transfer-and-transport belt 54 each have a hardness lower than that of the intermediate transfer body 30 and that of the counter roller 56. Consequently, the amount of deformation of the transfer belt unit 51, which faces the intermediate transfer body 30 and the counter roller 56 in the second transfer region TR, with respect to the nip pressure Np becomes large. Thus, in the present example, the nip pressure Np is slightly adjusted by providing the nip-pressure adjusting mechanisms 130 on the side of the transfer belt unit 51.

—Position Adjustment by Position Adjusting Mechanism—

Figure 22A:
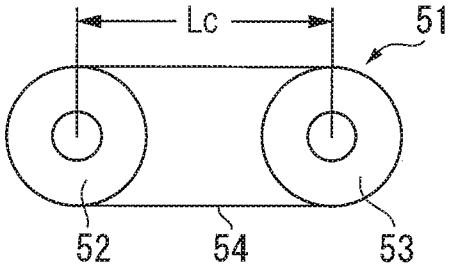
FIG. 22A is a diagram schematically illustrating a configuration example of the transfer belt unit.
Figure 22B:
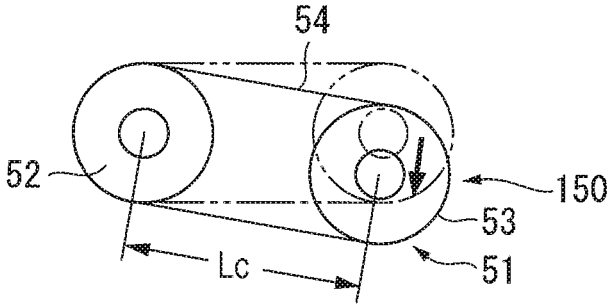
FIG. 22B is a diagram illustrating the behavior of the position adjusting mechanism when the position adjusting mechanism performs position adjustment.

In the present exemplary embodiment, as illustrated in FIGS. 22A and 22B, the position adjusting mechanism 150 maintains the fixed distance Lc between the center of the first stretching roller 52 of the transfer belt unit 51 and the center of the second stretching roller 53 of the transfer belt unit 51 at both the two ends of these rollers in the axial direction, and in this state, the position adjusting mechanism 150 displaces the front side position of the rotary shaft 53*a* of the second stretching roller 53 so as to adjust the position of the second stretching roller 53.

In this case, the movement speed of the transfer-and-transport belt 54 is constant at the two ends thereof in the widthwise direction.

Comparative Example 1

Figure 22C:
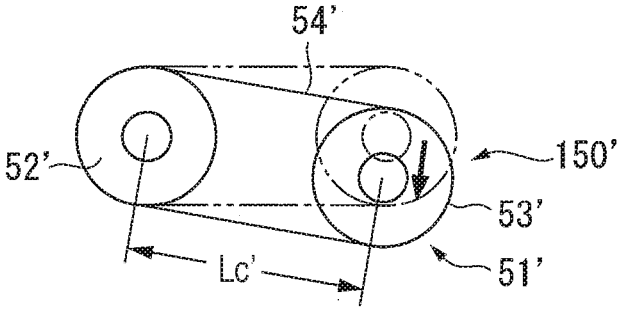
FIG. 22C is a diagram illustrating the behavior of a transfer belt unit that is used in a second transfer device according to Comparative Example 1 when position adjustment is performed.
Figure 22D:
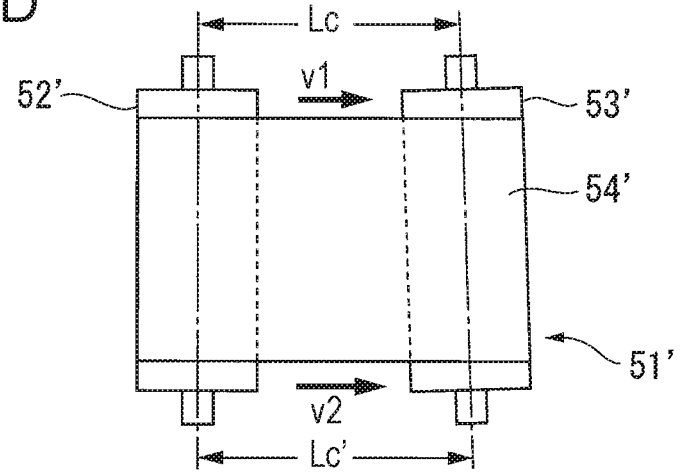
FIG. 22D is a diagram illustrating a stretched state of a transfer belt when a position adjusting mechanism according to Comparative Example 1 performs position adjustment.

Regarding the above matter, a position adjusting mechanism 150' according to Comparative Example 1 that is illustrated in FIG. 22C does not include the position locking mechanisms 151 of the exemplary embodiment and only includes, for example, the displacement mechanism 160, and thus, as illustrated in FIGS. 22C and 22D, when studies are conducted on a transfer-and-transport belt 54' of a transfer belt unit 51', even if the distance between the center of a first stretching roller 52' and the center of a second stretching roller 53' on the rear side is the dimension Lc, the distance between the centers of these rollers on the front side is a dimension LC' (≠Lc), and thus, the peripheral velocities of the two end portions of the transfer-and-transport belt 54' in the widthwise direction of the transfer-and-transport belt 54' are v1≠v2, which are different from each other. Therefore, there is a concern that the transfer-and-transport belt 54' may easily move in a serpentine manner.

—Positional Relationship between Second Transfer Device and Peripheral Component—

In the present exemplary embodiment, as illustrated in FIG. 6 and FIG. 7, although the static eliminating member (e.g., a static eliminating needle) 180 and the plate-shaped guide chute 185, which serves as a guiding unit that guides and transports a medium, are arranged downstream from the transfer-and-transport belt 54 of the transfer belt unit 51 in the transport direction, the relative positional relationship between the transfer belt unit 51 and the static eliminating member 180 or the guide chute 185 does not change even if the position of the transfer belt unit 51 is changed, and thus, the static eliminating effect of the static eliminating member 180 and the medium guiding performance of the guide chute 185 are maintained favorable.

In addition, although the second stretching roller 53 is disposed so as to be in contact with the contact 190, which is the portion connected to the high resistive element 58, the relative positional relationship between the second stretching roller 53 and the contact 190 is maintained favorable even if the position of the transfer belt unit 51 is changed.

Furthermore, although the transfer belt unit 51 is provided with the cleaning unit 170, the cleaning unit 170 moves so as to follow the transfer belt unit 51 even if the position of the transfer belt unit 51 is changed, and thus, the relative positional relationship between the transfer belt unit 51 and the cleaning unit 170 is maintained favorable.

Comparative Example 2

Figure 23:
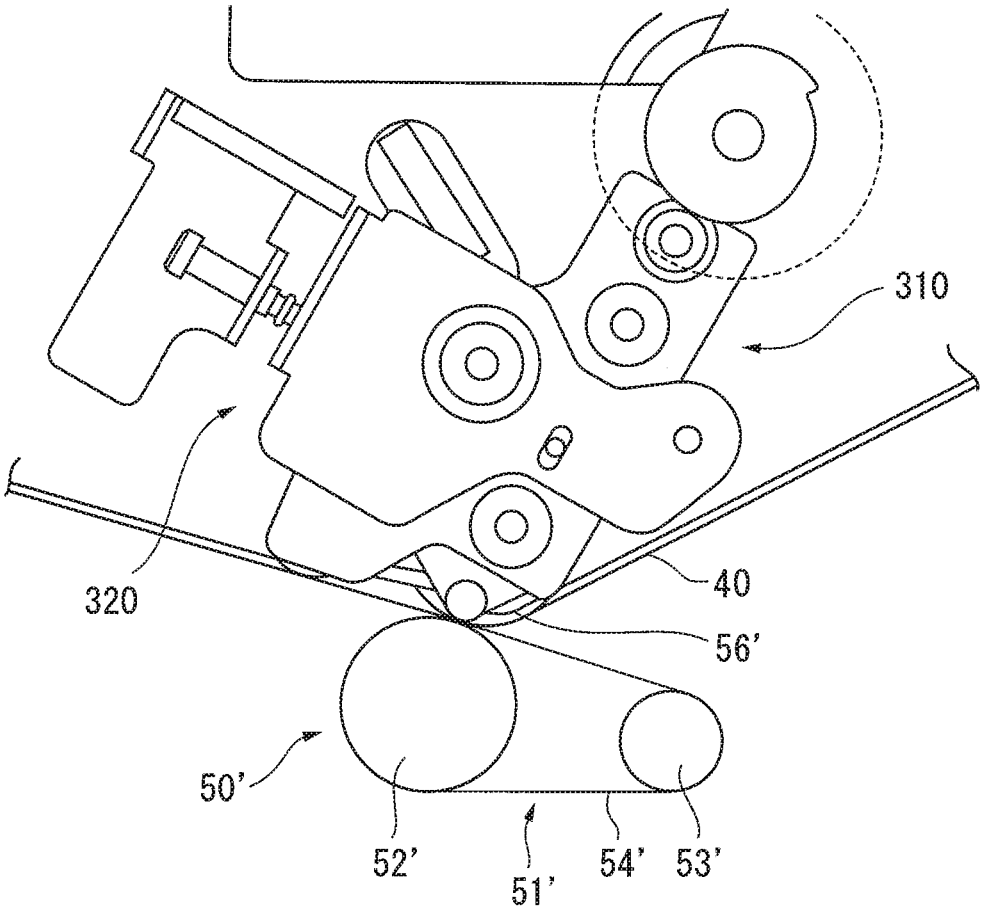
FIG. 23 is a diagram illustrating a configuration example of a nip-pressure adjusting mechanism in a second transfer region according to Comparative Example 2.

FIG. 23 illustrates an example of an image forming apparatus according to Comparative Example 2.

In FIG. 23, a second transfer device 50' includes a transfer belt unit 51' in which a transfer-and-transport belt 54' is stretched between a first stretching roller 52' and a second stretching roller 53', and in the present example, the second transfer device 50' further includes a nip-pressure adjusting mechanism 310 that presses a counter roller 56' of an intermediate transfer body 40 against the transfer belt unit 51' and a parallelism adjustment mechanism 320 that adjusts the parallelism of the counter roller 56' in the transverse direction, which crosses a nip-pressure adjustment direction.

In the present example, nip-pressure adjustment or the like is not performed on the transfer belt unit 51', and nip-pressure adjustment and parallelism adjustment is performed on the counter roller 56'.

In the present example, it is difficult to maintain both the nip pressure and the parallelism of the counter roller 56' favorable, and if the adjustment of the parallelism of the counter roller 56' is insufficient, there is a concern that the transfer-and-transport belt 54' of the transfer belt unit 51' may easily be skewed.

As described above, it is understood that nip-pressure adjustment and parallelism adjustment in the image forming apparatus according to Comparative Example 2 are likely to be insufficient compared with the exemplary embodiment.

Modifications

In the exemplary embodiment, although an aspect in which the nip-pressure switching mechanisms 120 and the nip-pressure adjusting mechanisms 130 are provided is described, for example, it is obvious that only the nip-pressure adjusting mechanisms 130 may be used without using the nip-pressure switching mechanisms 120 for a medium processing device in which the type of media to be used is predetermined.

In addition, in the exemplary embodiment, although the retracting mechanisms 110, the nip-pressure switching mechanisms 120, the nip-pressure adjusting mechanisms 130, and the position adjusting mechanism 150 are each configured to use a rotary eccentric member (a cam member), the present disclosure is not limited to this configuration, and each of these mechanisms may be displaced by using an advance/retreat member that is capable of moving forward, backward, and in a curved manner or an actuator instead of such a rotary eccentric member.

In the exemplary embodiment, although the nip-pressure adjusting mechanisms 130 are disposed on the front side and the rear side of the belt transfer module 200, the nip-pressure adjusting mechanism 130 may be provided only on the front side (near side) of the belt transfer module 200 by taking into consideration the operability at the time of adjustment. Although an aspect has been described in which the position adjusting mechanism 150 is provided only on the front side (near side) of the belt transfer module 200 by taking into consideration the operability at the time of adjustment, it is obvious that, in the case where the position of the transfer belt unit 51 is desired to adjusted before the belt transfer module 200 is installed in the apparatus housing 21, the position adjusting mechanism 150 may also be provided on the rear side (far side) of the belt transfer module 200.

In addition, in the present example, although a user adjusts the nip-pressure adjusting mechanisms 130 and the position adjusting mechanism 150 manually or by using a jig, if a method of driving the slight adjustment cams 131 of the nip-pressure adjusting mechanisms 130 and the displacement adjustment cam 169 of the position adjusting mechanism 150 by using a driving source or an actuator is employed, the control device 100 may check whether the state of the nip pressure and the walking state of the transport belt 2 are appropriate and the state of the nip pressure and the walking state of the transport belt 2 may be automatically adjusted.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device comprising:

a transport belt that is disposed in such a manner as to face an image holding unit comprising a belt-shaped intermediate transfer body holding an image and that is capable of moving circularly so as to transport a medium;

a first stretching roller that stretches a portion of the transport belt and that is disposed in such a manner as to face the image holding unit, the first stretching roller being configured to transport the medium by nipping the medium between the image holding unit and the transport belt and configured to transfer the image held by the image holding unit onto the medium;

a second stretching roller that stretches a portion of the transport belt that is located downstream from the portion of the transport belt stretched by the first stretching roller in a transport direction of the medium;

a contact adjusting unit comprising a link arm that causes a second end of the first stretching roller in an axial direction of the first stretching roller to swing while a first end of the first stretching roller serves as a fulcrum and adjusts a contact state between the image holding unit and the transport belt in a longitudinal direction of a contact region between the image holding unit and the transport belt; and a position adjusting unit comprising a displacement adjustment plate that keeps a distance between a center of the first stretching roller and a center of the second stretching roller constant and adjusts a position of the second stretching roller with respect to the first stretching roller by causing a second end of the second stretching roller to swing while a first end of the second stretching roller serves as a fulcrum.

2. The medium transport device according to claim 1, wherein the link arm causes the second end of the first stretching roller in the axial direction to swing toward the image holding unit, which faces the first stretching roller.

3. The medium transport device according to claim 2, wherein the link arm linearly moves forward and backward via an eccentric rotary member, and the link arm holds the second end of the first stretching roller in the axial direction such that the first stretching roller is rotatable.

4. The medium transport device according to claim 1, wherein the displacement adjustment plate includes position locking mechanisms including restricting rollers that are arranged at two ends of the first and second stretching rollers and that allow rotational operations of the first and second stretching rollers while keeping the distance between the center of the first stretching roller and the center of the second stretching roller constant and the link arm that causes the second end of the second stretching roller in the axial direction of the second stretching roller to swing while the second end of the first stretching roller in the axial direction of the first stretching roller serves as a fulcrum.

5. The medium transport device according to claim 4, wherein each of the restricting rollers is coaxial with a corresponding one of the first and second stretching rollers, space adjustment rollers that are interposed between the restricting rollers in such a manner as to be in contact with the restricting rollers, and holding frames each of which holds the restricting rollers and the space adjustment roller that are included in one of the position locking mechanisms such that the restricting rollers and the space adjustment roller are rotatable and such that axes of the restricting rollers and an axis of the space adjustment roller are aligned in a straight line.

6. The medium transport device according to claim 4, wherein the link arm causes the second end of the second stretching roller in the axial direction to move forward and backward in a direction that is substantially perpendicular to a reference line connecting the axial center of the first stretching roller and the axial center of the second stretching roller.

7. The medium transport device according to claim 1, further comprising:

a static eliminating needle that is located downstream from the transport belt in the transport direction of the medium and that removes static electricity from the medium, wherein the static eliminating needle moves so as to follow swing movement of the second stretching roller.

8. The medium transport device according to claim 2, further comprising:

a static eliminating needle that is located downstream from the transport belt in the transport direction of the medium and that removes static electricity from the medium, wherein the static eliminating needle moves so as to follow swing movement of the second stretching roller.

9. The medium transport device according to claim 3, further comprising:

a static eliminating needle that is located downstream from the transport belt in the transport direction of the medium and that removes static electricity from the medium, wherein the static eliminating needle moves so as to follow swing movement of the second stretching roller.

10. The medium transport device according to claim 4, further comprising:

a static eliminating needle that is located downstream from the transport belt in the transport direction of the medium and that removes static electricity from the medium, wherein the static eliminating needle moves so as to follow swing movement of the second stretching roller.

11. The medium transport device according to claim 1, further comprising:

a guiding chute that is located downstream from the transport belt in the transport direction of the medium and that guides the medium, wherein the guiding chute moves so as to follow swing movement of the second stretching roller.

12. The medium transport device according to claim 1, wherein the second stretching roller is grounded via a high resistive element, and a portion that is connected to the high resistive element moves so as to follow swing movement of the second stretching roller.

13. The medium transport device according to claim 11, wherein the transport belt, the first stretching roller, and the second stretching roller are mounted on a swing frame that is swingable with respect to a stationary frame, and the swing frame includes a portion that is connected to the static eliminating needle, the guiding chute, or the high resistive element.

14. The medium transport device according to claim 1, further comprising:

a cleaning unit comprising a cleaning blade that is disposed on the portion of the transport belt that is stretched by the first stretching roller and that cleans the transport belt, wherein the cleaning unit moves so as to follow swing movement of the first stretching roller.

15. The medium transport device according to claim 14, wherein a cleaning housing of the cleaning unit moves about a predetermined fulcrum so as to follow swing movement of the first stretching roller.

16. A medium processing device comprising:

an image holding unit that holds an image; and the medium transport device according to claim 1 that is disposed in such a manner as to face the image holding unit and that transfers and transports the image held by the image holding unit.

17. The medium processing device according to claim 16, further comprising:

a retracting gear that causes the medium transport device to come into and out of contact with the image holding unit.

18. The medium processing device according to claim 16, wherein the image holding unit includes a second contact adjusting unit comprising a second link arm that adjusts a contact state in the contact region more roughly than the contact adjusting unit of the medium transport device does.

19. The medium processing device according to claim 18, wherein the medium transport device is disposed below the image holding unit in such a manner as to be capable of being drawn out from a housing of the medium processing device.

20. The medium processing device according to claim 18, wherein an opposing component of the medium transport device that faces an opposing component of the image holding unit with the contact region interposed between the opposing components has a hardness lower than a hardness of the opposing component of the image holding unit.

* * * * *